US007010491B1

(12) United States Patent
Kikumoto

(10) Patent No.: US 7,010,491 B1
(45) Date of Patent: Mar. 7, 2006

(54) METHOD AND SYSTEM FOR WAVEFORM COMPRESSION AND EXPANSION WITH TIME AXIS

(75) Inventor: Tadao Kikumoto, Sizuoka (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 09/456,665

(22) Filed: Dec. 9, 1999

(51) Int. Cl.
*G10L 21/04* (2006.01)

(52) U.S. Cl. ..... 704/503; 704/211; 704/229; 704/267; 84/604; 84/612; 381/106; 381/107

(58) Field of Classification Search ..... 704/503, 704/211, 229, 267, 278, 201; 84/604–607, 84/612; 381/106, 107
See application file for complete search history.

(56) References Cited

U.S. PATENT DOCUMENTS

| | | | | | |
|---|---|---|---|---|---|
| 3,946,504 | A | | 3/1976 | Nakano | 35/35 |
| 3,975,763 | A | * | 8/1976 | Kitamura | 704/267 |
| 4,025,723 | A | * | 5/1977 | Blackledge | 381/107 |
| 4,430,754 | A | * | 2/1984 | Ishigaki | 381/107 |
| 4,679,480 | A | * | 7/1987 | Suzuki | 84/604 |
| 4,805,217 | A | | 2/1989 | Morihiro et al. | 381/35 |
| 4,876,937 | A | * | 10/1989 | Suzuki | 84/612 |
| 5,315,057 | A | | 5/1994 | Land et al. | 84/601 |
| 5,347,478 | A | * | 9/1994 | Suzuki et al. | 704/211 |
| 5,412,152 | A | * | 5/1995 | Kageyama et al. | 84/607 |
| 5,471,009 | A | | 11/1995 | Oba et al. | 84/645 |
| 5,499,316 | A | | 3/1996 | Sudoh et al. | 395/2.79 |
| 5,511,000 | A | | 4/1996 | Kaloi et al. | 364/514 |
| 5,566,154 | A | * | 10/1996 | Suzuki | 704/229 |
| 5,611,018 | A | | 3/1997 | Tanaka et al. | 395/2.24 |
| 5,642,383 | A | * | 6/1997 | Suzuki | 704/229 |
| 5,675,709 | A | * | 10/1997 | Chiba | 704/278 |
| 5,713,021 | A | | 1/1998 | Kondo et al. | 395/614 |
| 5,717,818 | A | | 2/1998 | Nejime et al. | 395/2.2 |
| 5,734,119 | A | | 3/1998 | France et al. | 84/622 |
| 5,745,650 | A | | 4/1998 | Otsuka et al. | 395/2.69 |
| 5,763,800 | A | | 6/1998 | Rossum et al. | 84/603 |
| 5,765,129 | A | | 6/1998 | Hyman et al. | 704/270 |
| 5,774,863 | A | | 6/1998 | Okano et al. | 704/278 |
| 5,781,696 | A | | 7/1998 | Oh et al. | 395/2.79 |
| 5,792,971 | A | | 8/1998 | Timis et al. | |
| 5,809,454 | A | | 9/1998 | Okada et al. | 704/214 |
| 5,847,303 | A | | 12/1998 | Matsumoto | 84/610 |

(Continued)

FOREIGN PATENT DOCUMENTS

JP 1986-015183 * 1/1986

(Continued)

OTHER PUBLICATIONS

Keith Lent, *An Efficient Method for Pitch Shifting Digitally Sampled Sounds*, Computer Music Journal, vol. 13, No. 4 Winter 1989, pp 65-71.

*Primary Examiner*—Vijay Chawan
(74) *Attorney, Agent, or Firm*—Foley & Lardner LLP

(57) ABSTRACT

With the goal of presenting a waveform compression and expansion apparatus with which the sound quality of such things as musical tones that are expressed by waveforms is satisfactory following the compression and expansion of the waveforms of the musical tones etc., a method and system for waveform compression and expansion is disclosed in which all of the multiple number of band divided waveforms that comprise the original waveform which has been band divided are apportioned to at least two kinds of compression and expansion formats and form a multiple number of compressed and expanded waveforms by compression or expansion an identical amount only in the direction of the temporal axis.

29 Claims, 14 Drawing Sheets

U.S. PATENT DOCUMENTS

| | | | | |
|---|---|---|---|---|
| 5,873,059 | A | 2/1999 | Iijima et al. | 704/207 |
| 5,886,278 | A | 3/1999 | Yoshida | 84/604 |
| 6,169,240 | B1 * | 1/2001 | Suzuki | 704/503 |
| 6,323,797 | B1 * | 11/2001 | Kikumoto et al. | 84/604 |

FOREIGN PATENT DOCUMENTS

| | | | |
|---|---|---|---|
| JP | 2000-075899 | * | 3/2000 |
| JP | 2001-255876 A | * | 9/2001 |

* cited by examiner

METHOD AND SYSTEM FOR WAVEFORM COMPRESSION AND EXPANSION WITH TIME AXIS

BACKGROUND OF THE INVENTION

1. Field of the Invention

The invention relates to a waveform compression and expansion apparatus with which a waveform is compressed or expanded in the direction of the temporal axis.

2. Description of Related Art

For some time, the changing of the pitch of musical tones etc. by transforming the pitch of the signal that expresses the waveform of the musical tones etc., the so-called pitch shifter, has been known. However, when the pitch of a signal that expresses the waveform of a phrase, which has a length to the degree that the tempo of the musical tones is known, is transformed by the pitch shifter, there is a problem in that the tempo of the musical tones is also changed and there has been a desire for a system with which only the pitch is changed without changing the tempo of the musical tones. Conversely, a system with which the tempo is changed while the pitch of the musical tones is preserved has also been desired.

As a system that responds to these demands, a waveform compression and expansion apparatus with which the waveform of the musical tones etc. is compressed or expanded in the direction of the temporal axis independently of the alteration of the pitch has been proposed.

However, a multiple number of compression and expansion formats can be considered as the format with which the waveform will be compressed or expanded. In addition, with regard to the waveform that expresses the sound, there are various kinds of waveforms such as periodic waveforms, aperiodic waveforms, intermittent waveforms and continuous waveforms and, a compression and expansion processing format can be considered that appropriately compresses or expands the waveform in the direction of the temporal axis in conformance with the type of waveform. That is to say, for a given waveform, when the compression and expansion are carried out with a format that is appropriate to the variety of that waveform, the tonal quality of the sound that is expressed by the waveform following compression and expansion will be satisfactory. However, in the case where, for a given waveform, the compression and expansion is done with a format that is not appropriate to the variety of that waveform, the tonal quality of the sound that is expressed by the waveform following compression and expansion will be poor.

However, in general, the waveforms of musical tones etc. are waveforms in which various kinds of waveforms have been mixed together. Because of this, no matter which compression and expansion processing format is employed, there is a problem in that it is likely that the tonal quality of the musical tones etc. that is expressed by the waveform following the compression and expansion of the waveform of the musical tones etc. will be poor.

SUMMARY OF THE DISCLOSURE

The present invention, taking into account the above mentioned circumstances, was made with the object of presenting a waveform compression and expansion apparatus with which the tonal quality of the musical tones etc. that is expressed by the waveform following the compression and expansion of the waveform of the musical tones etc. will be satisfactory.

The first waveform compression and expansion apparatus of the present invention that achieves the above mentioned object is characterized in that it comprises a compression and expansion means with which a multiple number of band divided waveforms that comprise the original waveform which has been divided into waveform components of a multiple number of frequency bands are apportioned to at least two kinds of compression and expansion formats and all of these multiple number of band divided waveforms are formed into a multiple number of compressed and expanded waveforms by means of compression or expansion in the direction of the temporal axis an identical amount only and a superimposing means in which, by means of the superimposing of the multiple number of compressed and expanded waveforms that have been formed by the compression and expansion means, a compressed and expanded waveform that has been compressed or expanded in the direction of the temporal axis from the above mentioned original waveform is formed.

With a waveform that expresses musical tones etc. in which various kinds of waveforms have been mixed together, in general, due to the division into waveform components of a multiple number of frequency bands, there are many cases in which the separation of the waveform types can be done.

Since, in accordance with the first waveform compression and expansion apparatus of the present invention, the multiple number of band divided waveforms that comprise the waveform components of a multiple number of frequencies that the original waveform has been divided into are apportioned to at least two kinds of compression and expansion formats and compressed or expanded in the direction of the temporal axis, even in those cases where a waveform that expresses musical tones etc. is used as the original waveform, due to the fact that the compression and expansion are carried out by compression and expansion formats that are appropriate to each of the various kinds of band divided waveforms, it is possible to form compressed and expanded waveforms that express musical tones etc. having satisfactory tonal quality.

In addition, in general, when a single kind of compression and expansion format is employed and compression and expansion are done, it is likely that periodic noise similar to flutter or a vibrato effect will be produced. This effect is the result of the looping of cycles. However, in accordance with the first waveform compression and expansion apparatus of the present invention, each compression and expansion format with which each band divided waveform is compressed and expanded is selected so that the phase of each compressed and expanded waveform becomes a phase that is mutually different and, by this means, it is possible to prevent the flutter or vibrato effect.

With the first waveform compression and expansion apparatus of the present invention, it is preferable that the above mentioned compression and expansion means execute compression and expansion processing with a processing period that is as long as the band divided waveform which possesses the waveform component of the low frequency band in the above mentioned multiple number of band divided waveforms and, by this means, forms the compressed and expanded waveforms that correspond to said band divided waveforms.

In general, those waveform components that are as long as the waveform components of the low frequency band are waveform components that are important to the human sense of hearing. Because of that, the implementation of advanced compression and expansion processing demands a processing time that is as long as the waveform component of the low frequency band. In addition, in general, even if the frequency of the processing that has a period as long as the waveform component of the low frequency band is reduced, the tonal quality can be maintained.

Because of this, by means of the implementation of compression and expansion processing with a processing period that is as long as the band divided waveform which possesses the waveform component of the low frequency band, it is possible to produce a temporal margin for the implementation of advanced compression and expansion processing with the waveform component of the low frequency band and all of the waveform components can be compressed and expanded with satisfactory efficiency.

The second waveform compression and expansion apparatus of the present invention that achieves the above mentioned object is characterized in that it comprises a compression and expansion means in which a multiple number of compression and expansion processing formats that are mutually different are employed and the waveforms are compressed or expanded in the direction of the temporal axis and a processing format specification means in which the compression and expansion formats of each of the temporally divided waveforms are specified so that the compression and expansion processing of the multiple number of time divided waveforms that comprise the original waveform which has been divided into a multiple number of temporal regions are allotted to the above-mentioned multiple number of compression and expansion formats and the compression and expansion means employs the compression and expansion format that has been specified by the processing format specification means for each temporally divided waveform and carries out compression and expansion processing.

With a waveform that expresses musical tones etc. in which various kinds of waveforms are mixed together, there are many cases where the varieties of waveforms can be separated by a division into a multiple number of temporal regions.

Since in accordance with the second waveform compression and expansion apparatus of the present invention, the multiple number of temporally divided waveforms that comprise the original waveform which has been divided into a multiple number of temporal regions are allotted to a multiple number of varieties of compression and expansion formats and compressed or expanded in the direction of the temporal axis, even in those cases where a waveform that expresses musical tones etc. has been used as the original waveform, due to the fact that compressions and expansions are carried out with the compression and expansion processing formats that are appropriate to each of the various kinds of waveforms, it is possible to form compressed and expanded waveforms that express the musical tones etc. with satisfactory tonal quality.

As has been discussed above, in accordance with the waveform compression and expansion apparatus of the present invention, the tonal quality of the musical tones etc. which the waveform expresses following the compression and expansion of the waveforms of the musical tones etc. is satisfactory.

DETAILED DESCRIPTION OF PREFERRED EMBODIMENTS

Below, in providing an explanation of the preferred embodiments of the present invention, first an explanation will be given of examples of compression and expansion processing formats and, following that, an explanation will be given regarding the preferred embodiments of the waveform compression and expansion apparatus of the present invention.

In the following explanation, there are cases where no differentiation is made between the concept of a waveform and the concept of the waveform data that express that waveform.

In addition, in the following explanations of each of the compression and expansion processing formats, the waveform prior to compression and expansion, whether it is the original waveform or a frequency band-divided waveform, is called the "original waveform" and the waveform following compression and expansion is called the "compressed and expanded waveform." Furthermore, an explanation will be given here regarding the case where the compressed and expanded waveform in which the original waveform has been expanded in the direction of the temporal axis is formed having the same pitch as the pitch of the original waveform.

Figure 1:
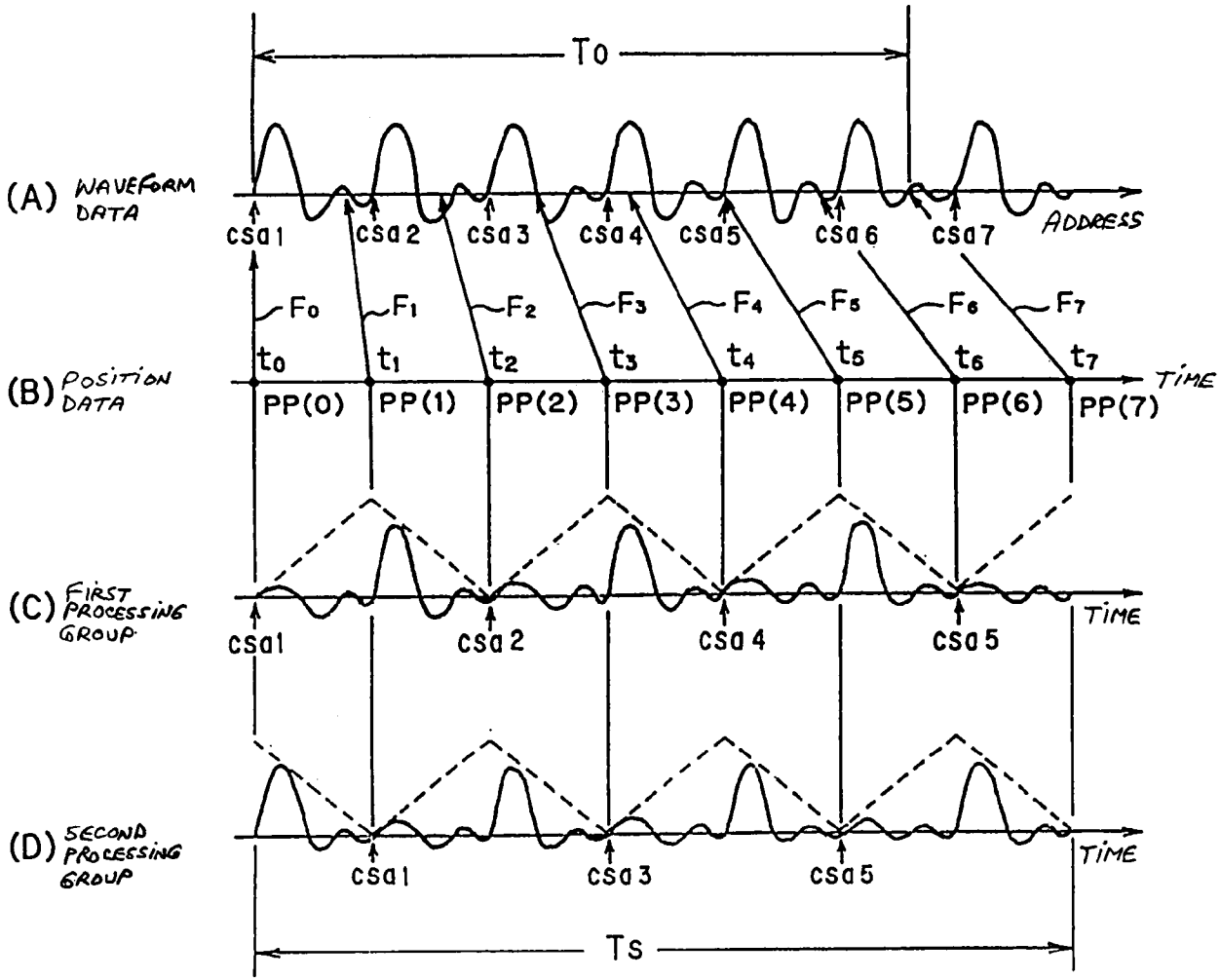
FIG. 1 is an explanatory drawing of the first compression and expansion processing format according to an embodiment of the present invention.

FIG. 1 is an explanatory drawing of the first compression and expansion processing format.

With the first compression and expansion format, as is explained in detail below, an opening and starting address is set on the original waveform that delimits each pitch or cycle of the original waveform, and pitches or cycles from the original waveform is read out alternately by two processing groups. A processed waveform is formed by each of the processing groups based on the original waveform that has been read out and all of the processed waveforms that have been formed are superimposed on each other forming a compressed and expanded waveform. When the original waveform is read out, the waveform is compressed or expanded in the direction of the temporal axis by the carrying out of jump reading (skipping of cycles) or repetitive read-out (repetition of cycles).

The original waveform is shown in the topmost stage of FIG. 1(*a*). The horizontal axis of FIG. 1 (*a*) shows the address of the waveform data that express the original waveform and, together with this, also corresponds to the temporal axis of the original waveform. In addition, in FIG. 1(*a*), the opening and starting addresses csa1, . . . , csa7, which delimit the original waveform one pitch or cycle at a time, are shown. The opening and starting addresses may delimit cycles at zero-crossings of the original waveform, or alternatively, energy peaks of the original waveform. Zero-crossings are preferably used for aperiodic waveforms, while energy peaks are preferably used for periodic waveforms.

In FIG. 1(*b*), the time points $t_0, \ldots, t_7$, which are arranged on the temporal axis at time intervals that correspond to the reproduced pitch or cycle of the compressed and expanded waveform, are shown and in the specific example of FIG. 1, for each time point to, . . . $t_7$, the waveform data for the amount of approximately two pitches of the original waveform are read out. However, it should be noted that generally, the amount of pitch or cycle data read out at each time point is dependent on the how much the original waveform is being compressed or expanded. In addition, in FIG. 1(*b*), the position information elements that indicate the positions on the original waveform, PP(0), . . . , PP(7), are shown and the positions that are indicated by each of the position information elements PP(0), . . . , PP(7) are the objects of the read-outs that are started at each time point to, $t_7$. Furthermore, the positions on the original waveform that are indicated by each of the position information elements PP(0), . . . , PP(7) are indicated by each arrow $F_0 \ldots, F_6$ that points from FIG. 1(*b*) to FIG. 1(*a*) with the time points $t_0, \ldots, t_7$ as their starting points and each arrow $F_0, \ldots, F_6$ is shown in a position that is further left in the figure that the opening and starting addresses csa1, . . . , csa7.

Here, the intervals of each of the opening and starting addresses csa1, . . . , csa7 that are shown in FIG. 1(*a*) and the intervals of each of the time points $t_0, \ldots, t_6$ that are shown in FIG. 1(*b*) are mutually identical and, as was discussed above, form compressed and expanded waveforms that have pitches which are the same as the pitches of the original waveform. In addition, the positions on the original waveform that are indicated by each of the position information areas PP(1), . . . , PP(6) are shown in a position that is more to the left in the figure than each of the opening and starting addresses csa2, . . . , csa7 and, because of this, as will be discussed later, a repetitive read-out of the waveform data is carried out forming, as has been discussed above, the compressed and expanded waveform of the original waveform that has been expanded in the direction of the temporal axis.

The triangular waveforms that are shown by the dotted lines in FIG. 1(*c*) and FIG. 1(*d*) indicate the window or envelope that is used by the first processing group and that is used by the second processing group respectively and the waveforms that are shown by the solid lines if FIG. 1(*c*) and FIG. 1(*d*) indicate each of the processed waveforms. The window or envelope produces a waveshaping function that limits the amplitude of the processed waveform. Because the envelope may not coincide with zero-crossing of the original waveform in other embodiments, the triangular envelope of FIG. 1 forces the amplitude of the waveform data to be zero at the start and end of each envelope, which essentially creates a zero-crossing at the start and end of each envelope. Having a zero-crossing at the boundary of each cycle helps to minimize discontinuities in the compressed waveform and resultant sound when the cycles are looped. In the specific example of FIG. 1, the opening and starting addresses are shown in FIG. 1(*c*) and FIG. 1(*d*), and these opening and starting addresses correspond to the beginnings of the waveform data for the amount of two pitches that have been read out by each of the processing groups. Each processed waveform is mated and formed with the envelopes that are shown in FIG. 1(*c*) and FIG. 1(*d*) and the waveform data that have been read out by each of the processing groups and these processed waveforms are superimposed forming the compressed and expanded waveform.

The read-out of the waveform data by the first processing group is started at the time point $t_0$. Since, as is shown in FIG. 1(*a*) and FIG. 1(*b*), the position information element PP(0) indicates the position of the opening and starting address csa1, as is shown in FIG. 1(*c*), the waveform data for the amount of two pitches is read out from the opening and starting address csa1. Thus, for FIG. 1(*c*), between time points to and $t_2$, original waveform data between opening and starting addresses csa1 and csa2 are read out twice. Again, it should be noted that generally, the amount of pitch or cycle data read out at each time point is dependent on the how much the original waveform is being compressed or expanded.

The read-out of the waveform data by the second processing group is started at the time point $t_1$. As is shown in FIG. 1(*a*) and FIG. 1(*b*), the position information element PP(1) indicates the position of the interval between the opening and starting address csa1 and the opening and starting address csa2. Because of this, this position is included among the read-out objects and, as is shown in FIG. 1(*d*), the waveform data for the amount of two pitches are read out from the opening and starting address csa1. Thus, for FIG. 1(*b*), between time points $t_1$ and $t_3$, original waveform data between opening and starting addresses csa1 and csa2 are read out twice. As a result, a repetitive read-out of the waveform data is carried out.

In the same manner as that described above, for the time points $t_2, \ldots, t_5$, the read-out of the waveform data for the amount of two pitches is started from the opening and starting addresses csa2, . . . , csa5.

For the time point $t_6$, as is shown in FIG. 1(*c*), the read-out of the waveform data by the first processing group for the amount of two pitches is started from the opening and starting address csa5 and a repetitive read-out of the waveform data is carried out.

As a result of this kind of repetitive read-out, the amount of the time interval To of the original waveform that is shown in FIG. 1(*a*) is expanded in the direction of the temporal axis and the compressed and expanded waveform is formed for the amount of the time interval Ts that is shown in FIG. 1(*d*).

Figure 2:
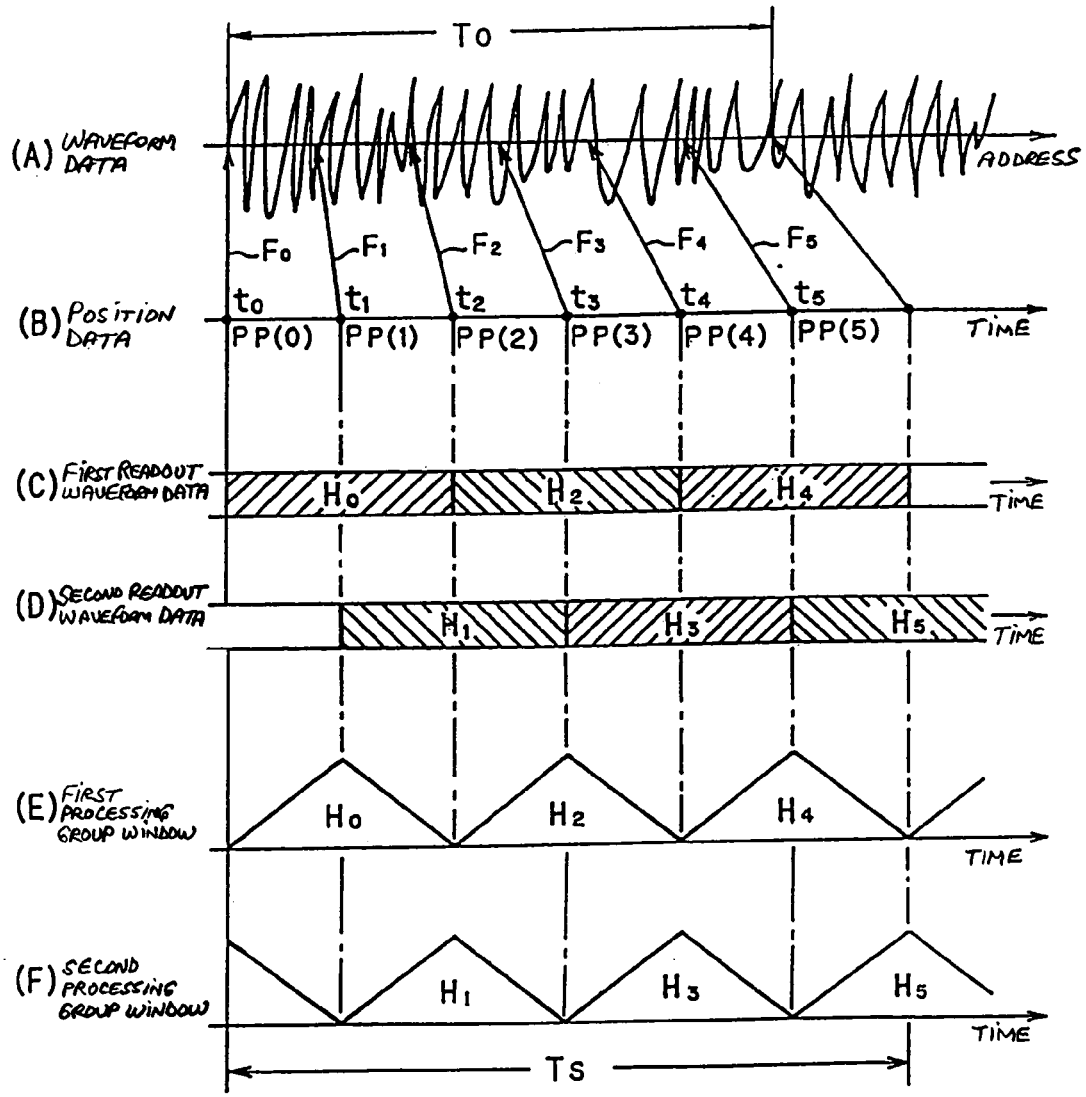
FIG. 2 is an explanatory drawing of the second compression and expansion processing format according to an embodiment of the present invention.

FIG. 2 is an explanatory drawing of the second compression and expansion processing format.

With the second compression and expansion format, as will be explained in detail below, portions of waveform portions are read out alternately by the two processing groups from the original waveform and these waveform portions are made the beginnings of the read-out starting positions that advance at a fixed speed on the original waveform. Each processed waveform is produced by each of the processing groups based on the waveform portions that have been read out and all of the processed waveforms that have been formed are superimposed forming a compressed and expanded waveform. The pitch of the compressed and expanded waveform is determined in conformance with the read-out speed of the waveform portions and the rate of compression or the rate of expansion in the direction of the temporal axis of the waveform is determined in conformance with the speed of advance of the read-out starting position.

In FIG. 2(*a*), the original waveform is shown and the horizontal axis of FIG. 2(*a*), together with indicating the address of the waveform data that expresses the original waveform, corresponds to the temporal axis of the original waveform.

In FIG. 2(*b*), the time points $t_0, \ldots, t_6$, at which each of the processing groups start the read-out of the waveform portions, are shown and the position information elements PP(0), . . . , PP(5) that indicate the read-out starting positions for each of the time points $t_0, \ldots, t_5$ are shown. In addition, the positions on the original waveform that are indicated by each of the position information elements PP(0), . . . , PP(5) are indicated by the arrows $F_0, \ldots, F_5$ that point toward FIG. 2(*a*) with each of the time points $t_0, \ldots, t_5$ as the starting points and each of the arrows $F_0, \ldots, F_5$ indicates a position that is equivalent to a time point that is more in the past than each of the time points $t_0, \ldots, t_5$.

In FIG. 2(*c*) and FIG. 2(*d*), the waveform portions $H_0, \ldots, H_5$ that have been read out alternately by the first processing group and the second processing group are shown and each waveform portion is made the beginning of each of the read-out starting positions that are indicated by each of the position information elements PP(0), . . . , PP(5).

In FIG. 2(*e*) and FIG. 2(*f*), the windows or envelopes that are used by the first processing group and the second processing group are shown and these windows and the waveform portions that are indicated by the codes that are annexed to each of the windows are mated forming each of the processed waveforms. The mating is a waveshaping function applied to the waveform portions by the windows. As described earlier, the triangular envelope creates zero crossings which minimize discontinuities when the waveform portions are looped. These processed waveforms are superimposed and the compressed and expanded waveform is formed.

Here, the speed of the read-out of each of the waveform portions $H_0, \ldots, H_5$ is identical to the recording speed of the original waveform. Because of this, the pitches of each of the waveform portions $H_0, \ldots, H_5$ following the read-outs by the first processing group and the second processing group that are shown in FIG. 2(*c*) and FIG. 2(*d*) are in agreement with the pitches that are possessed by each of the waveform portions $H_0, \ldots, H_5$ prior to the read-outs from the original waveform and, as discussed above, a compressed and expanded waveform having pitches that are identical to pitches of the original waveform is formed. In addition, since the speed of advance of the read-out starting position is slower than the recording speed and, as is shown in FIG. 1(*a*) and FIG. 1(*b*), each read-out starting position that corresponds to each of the time points $t_1, \ldots, t_5$ is equivalent to a starting point that is more in the past than each of the time points $t_1, \ldots, t_5$, for the reading out of the entire original waveform, it is necessary that the time be longer than the time for the recording of the entire original waveform. As a result, the amount of the time interval To of the original waveform that is shown in FIG. 2(*a*) has been extended in the direction of the temporal axis and the time interval portion of the compressed and extended waveform that is shown in FIG. 2(*f*) is formed.

Figure 3:
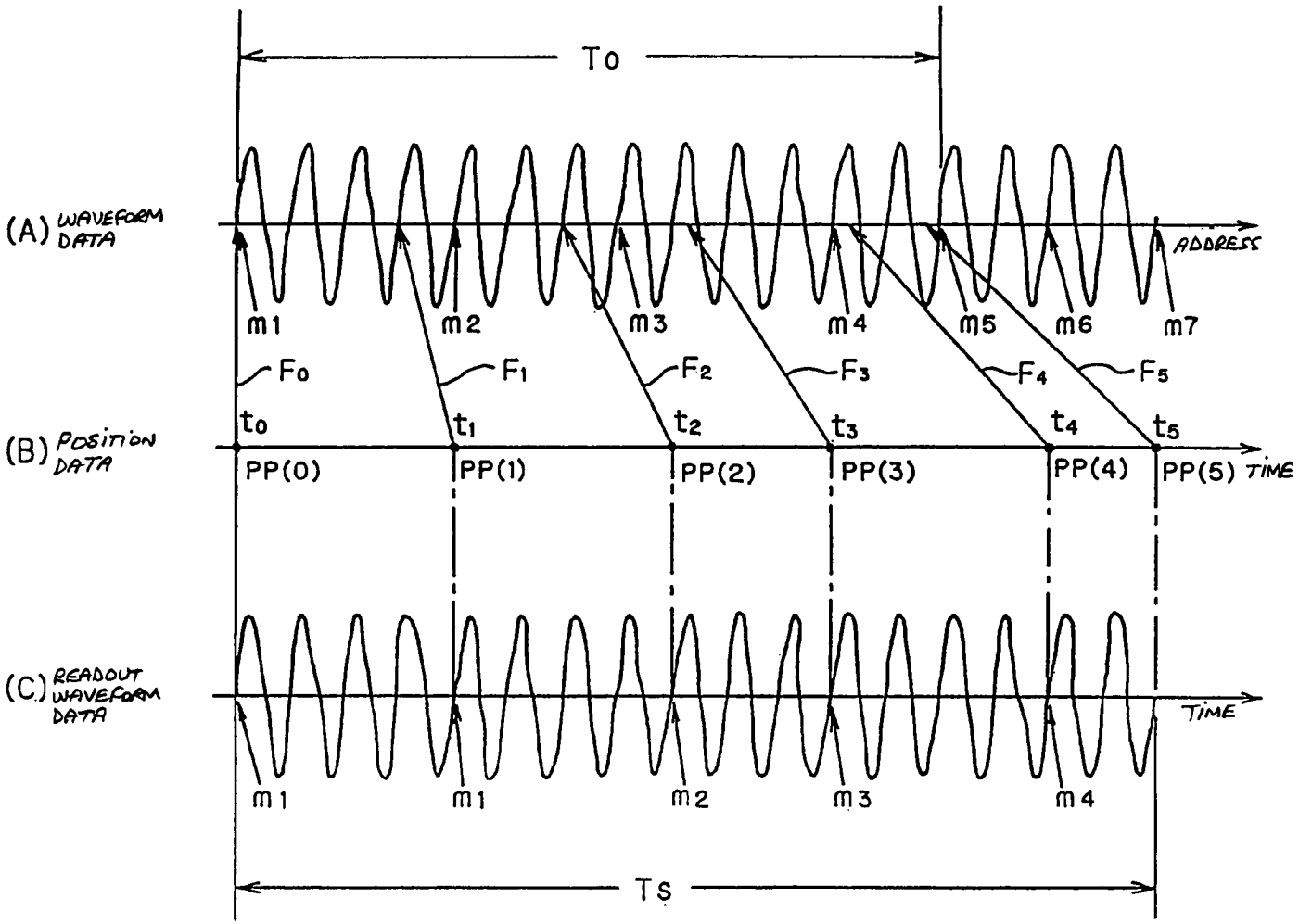
FIG. 3 is an explanatory drawing of the third compression and expansion processing format according to an embodiment of the present invention.

FIG. 3 is an explanatory drawing of the third compression and expansion processing format.

With the third compression and expansion processing format, as is explained in detail below, even if a cyclic reproduction of the original waveform is done, delimiting mark addresses for each waveform segment in which the reproduced sound is natural are set on the original waveform. The mark addresses designate zero-crossings of the original waveform, or alternatively, energy peaks of cycles in the original waveform. Zero-crossings are preferably used for aperiodic waveforms, while energy peaks are preferably used for periodic waveforms. Each of the waveform segments is read out in order and the compressed and expanded waveform is formed by their reproduction. The pitch of the compressed and expanded waveform is determined in conformance with the read-out speed of the waveform segments and, by the carrying out of the jump reading (skipping of waveform segments) or the reread-out of the waveform segments (repetition of waveform segments), the compression or expansion of the waveform is done.

In FIG. 3(*a*), the original waveform and the mark addresses $m_1, \ldots, m_7$ that have been set on the original waveform are shown and the horizontal axis of FIG. 1(*a*), together with indicating the addresses of the waveform data that express the original waveform, corresponds to the temporal axis of the original waveform.

In FIG. 3(*b*), the time points $t_0, \ldots, t_5$ at which the read-outs of each of the waveform segments start and each of the position information elements PP(0), . . . , PP(4) that indicate the positions on the original waveform are shown and each position information element PP(0), . . . , PP(4) becomes an object of the read-outs that are started for each time point $t_0, \ldots, t_5$. In addition, the positions on the original waveform that are indicated by each of the position information elements PP(0), . . . , PP(4) are indicated by each of the arrows $F_0, \ldots, F_5$ that point toward FIG. 3(*a*) with each of the time points $t_0, \ldots, t_5$ as the starting points. The arrow $F_0$ indicates the position of the mark address $m_1$ and the arrow $F_1$ indicates the position of the interval between the mark address $m_1$ and the mark address $m_2$. In addition, the arrow $F_2$ indicates the position of the interval between the mark address $m_2$ and the mark address $m_3$, the arrow $F_3$ indicates the position of the interval between the mark address $m_3$ and the mark address $m_4$ and the arrow $F_4$ indicates the position of the interval between the mark address $m_4$ and the mark address $m_5$.

In FIG. 3(*c*), the waveform segments that have been read out are shown and the mark addresses that correspond to the beginnings of each of the waveform segments are also shown.

As is shown in FIG. 3(*a*) and FIG. 3(*b*), since at the time point to, the position information element PP(0) indicates the position of the mark address $m_1$, as is shown in FIG. 3(*c*), the read-out of the waveform segment is started with the mark address $m_1$ as the beginning. Here, the read-out speed of the waveform interval is identical to the recording speed of the original waveform. Because of this, the pitch of the waveform segment that is shown in FIG. 3(*c*) is identical to the pitch of the original waveform that is shown in FIG. 3(*a*) and a compressed and expanded waveform is produced that has the same pitch as the pitch of the original waveform.

At the time point $t_1$ where the entire waveform segment, the read-out of which was begun at the time point to, has been read out, the position information element PP(1) indicates the position of the interval between the mark address $m_1$ and the mark address $m_2$. This position is included as an object of the read-out and, as is shown in FIG. 3(*c*), the reread-out of the waveform segment is begun with the mark address $m_1$ as the beginning.

After that, the read-out of the waveform segments is begun at each time point $t_2$, $t_3$ and $t_4$ with the mark addresses $m_2$, $m_3$ and $m_4$ respectively as the beginnings.

At the time point $t_5$ where the entire waveform segment, the read-out of which was begun at the time point $t_4$, has been read out, the position information element PP(5) indicates the position of the interval between the mark address $m_4$ and the mark address $m_5$. The reread-out of the waveform segment is begun with the mark address $m_4$ as the beginning so that this position is included as an object of the read-out.

As a result of this kind of reread-out having been carried out, the original waveform for the amount of the time interval To that is shown in FIG. 3(*a*) is expanded in the direction of the temporal axis and the compressed and expanded waveform for the amount of the time interval Ts that is shown in FIG. 3(*c*) is formed.

Above, an explanation was given regarding the expansion operations for three kinds of compression and expansion formats and, when the speed of advance of the position information elements for each of the formats is made faster, the read-out of the original waveform data becomes a jump reading (skipping of cycles or waveform segments). As a result, a compressed and expanded waveform is formed in which the original waveform has been compressed in the direction of the temporal axis.

In the above manner, it is possible to change the compression and expansion and their amount by setting the speed of advance of the position information element.

As described above, an explanation was given regarding three kinds of compression and expansion processing formats but the compression and expansion processing formats for the present invention are not limited to the formats for which explanations were given above and, as long as it is a format with which the waveform is compressed or expanded in the direction of the temporal axis, it may be used. In addition, with regard to the "multiple number of compression and expansion processing formats" and the "at least two kinds of compression and expansion processing formats" in the present invention, in addition to two kinds of compression and expansion formats from among the three kinds of compression and expansion formats for which explanations were given as described above being included, it also includes, for example, arbitrarily using the second compression and expansion processing format of the above mentioned explanation and a multiple number of compression and expansion formats with which the time intervals for the read-out of the waveform data portions are mutually different.

With the above, the explanations regarding examples of compression and expansion formats have been completed and an explanation concerning the preferred embodiments of the present invention will be given below.

The first preferred embodiment of the waveform compression and expansion apparatus of the present invention is a system in which all of the multiple number of band divided waveforms that comprise the waveform components of the multiple number of frequency bands into which the original waveform that expresses the musical tones etc. is divided are compressed or expanded an identical amount only in the direction of the temporal axis and each of the compressed and expanded waveforms is formed. The compressed and expanded original waveform from the original waveform that has been compressed and expanded in the direction of the temporal axis is formed by the superimposing of these compressed and expanded waveforms.

Figure 4:
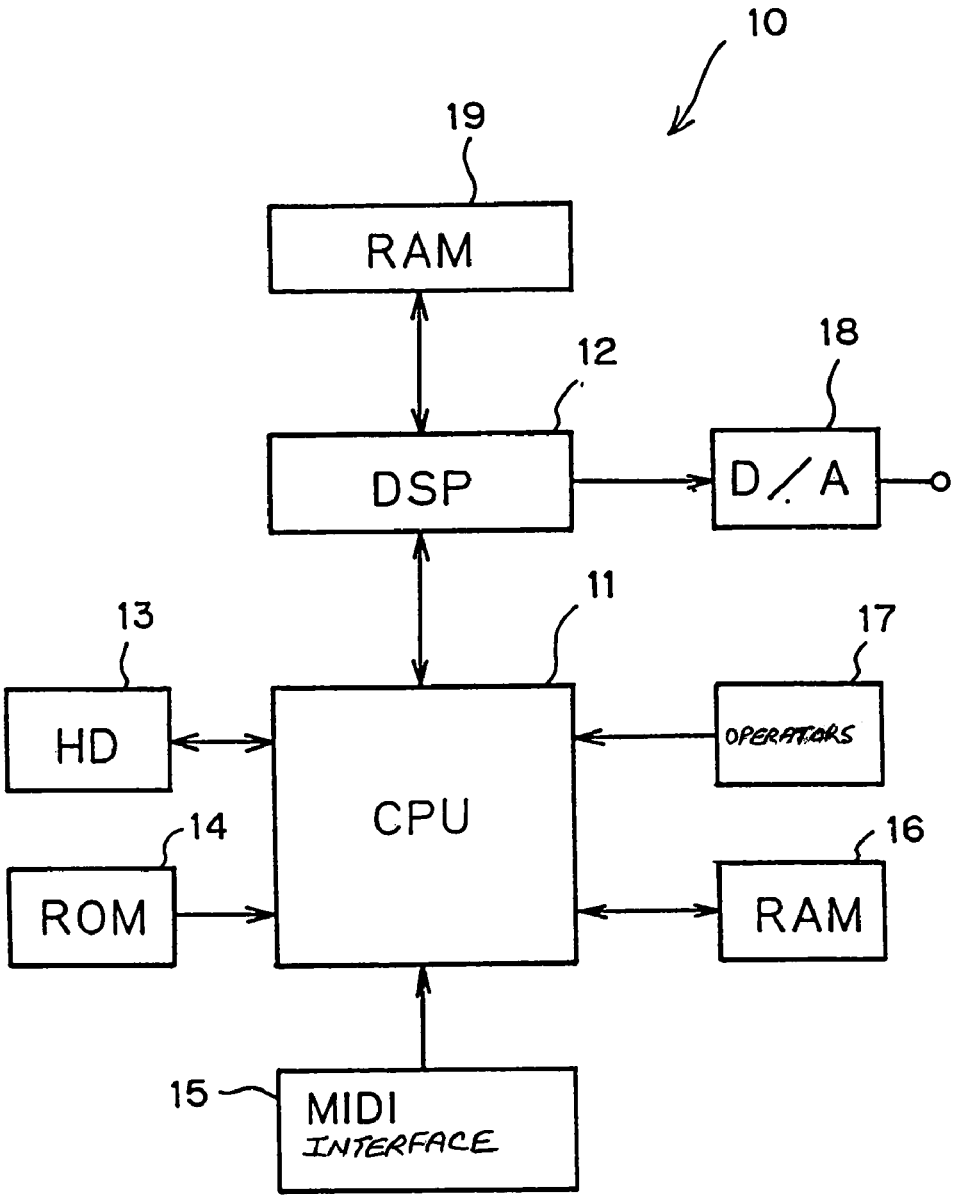
FIG. 4 is a hardware structural diagram of the first preferred embodiment of the waveform compression and expansion apparatus of the present invention.

FIG. 4 is a hardware structural diagram of the first preferred embodiment of the waveform compression and expansion apparatus of the present invention.

In the waveform compression and expansion apparatus 10, the CPU 11 and the DSP 12 are provided. The DSP 12 is controlled by the CPU 11 and, as will be discussed later, the compressed and expanded waveform is formed by the DSP 12.

In addition, in the waveform compression and expansion apparatus 10, the hard disk 13, the ROM 14, the MIDI interface 15, the first RAM 16 and the operators 17 are provided. On the hard disk 13, the waveform data of the original waveform that expresses the musical tones etc. is stored and, based on these waveform data, the band divided waveforms are formed by the DSP 12. In the ROM 14, the program that represents the operation of the CPU 11 and the DSP 12 is stored and the program that represents the operation of the DSP 12 is transmitted to the DSP 12 by the CPU 11. MIDI signals are input from outside via the MIDI interface 15 and the data that indicate the pitch that corresponds to this MIDI signal as well as the sound generation timing that corresponds to this MIDI signal are sent to the DSP 12 by the CPU 11. The first RAM 16 is used as working memory by the CPU 11 and the operators 17 are operated by the user of the waveform compression and expansion apparatus 10 in order to furnish instructions to the CPU 11.

In addition, in this waveform compression and expansion apparatus 10, the D/A converter 18 and the second RAM 19 are provided. In the second RAM 19, the divided waveform data that indicate the band divided waveforms are stored and compressed and expanded waveforms as well as the compressed and expanded original waveform are formed by the DSP 12 based on the divided waveform data. The D/A converter 18 changes the digital signal that expresses the compressed and expanded original waveform which has been formed by the DSP 12 into an analog signal.

Figure 5:
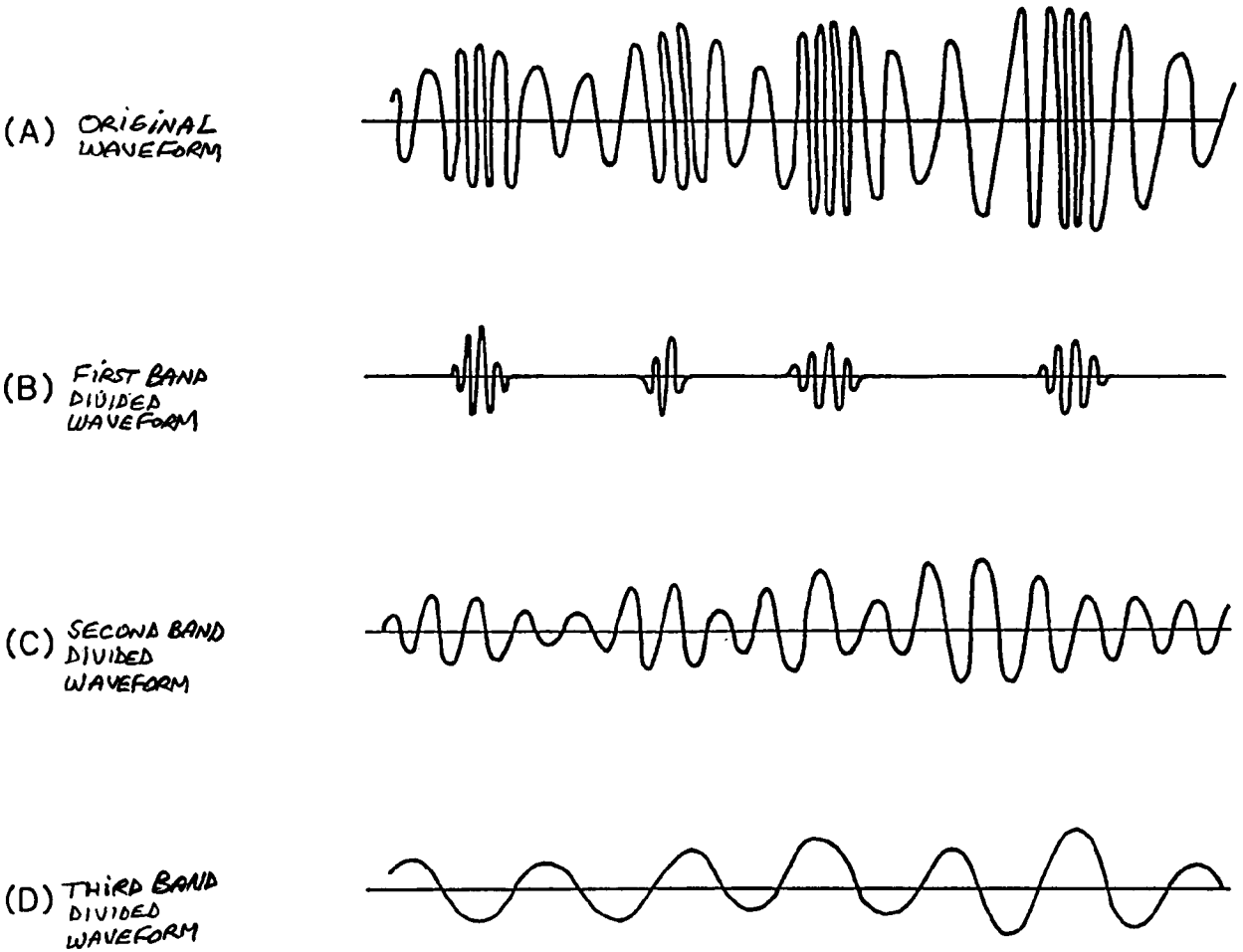
FIG. 5 is a diagram that shows one example of a band divided waveform according to an embodiment of the present invention.

FIG. 5 is a diagram that shows one example of a band divided waveform.

The original waveform is divided into three frequency band waveform components in the first preferred embodiment.

An example of an original waveform is shown in FIG. 5(*a*). This waveform is a waveform that represents a continuous sound of which the sound of a violin etc. is representative.

In FIG. 5(*b*), the first band divided waveform which possesses the waveform component of the frequency band from among the three frequency bands that has the highest frequency is shown and this first divided band waveform is an intermittent waveform.

In FIG. 5(*c*), the second band divided waveform which possesses the waveform component of the frequency band from among the three frequency bands that has the median frequency is shown and in FIG. 5(*d*), the third band divided waveform which possesses the waveform component of the frequency band from among the three frequency bands that has the lowest frequency is shown.

In addition to the waveform that is shown in FIG. 5(*a*), the one musical instrument sound that was discussed previously is not the only one that can be given as an example of a waveform for which compression and expansion by means of the waveform compression and expansion means of the present invention is desirable and there are waveforms that express the performance sounds of various kinds of musical instruments and performance states including those of a combined performance by a multiple number of musical instruments.

Figure 6:
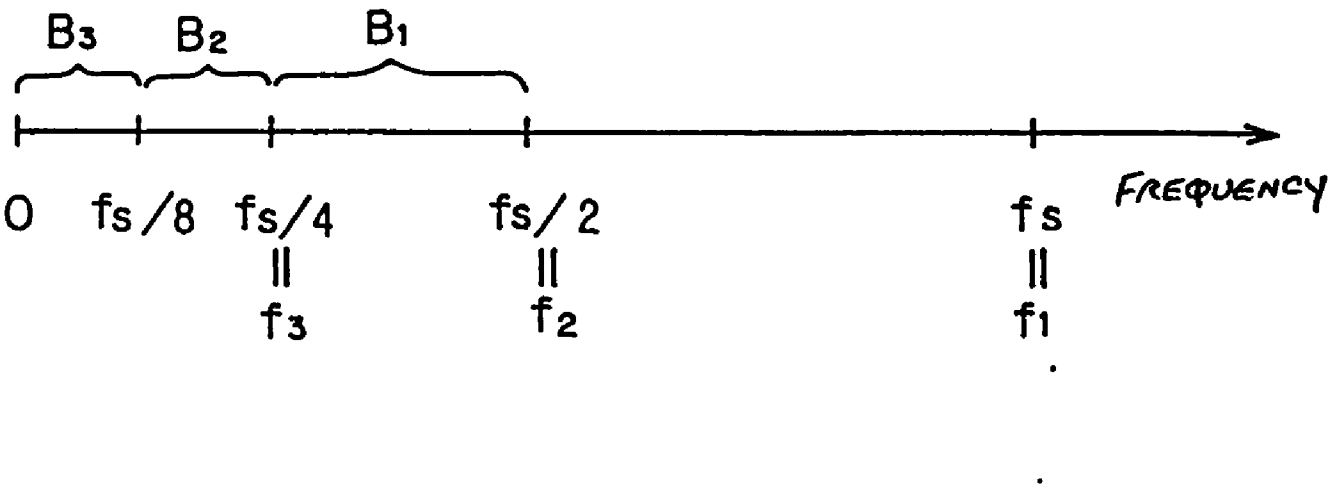
FIG. 6 is a diagram that shows the frequency bands of the waveform components that each of the band divided waveforms possesses according to an embodiment of the present invention.

FIG. 6 is a diagram that shows the frequency bands of the waveform components that each of the band divided waveforms possesses.

In this preferred embodiment, the waveform data that express the original waveform are sampled at a sampling frequency fs and waveform components that have a frequency of fs/2 or less are included in the original waveform. The frequency band $B_1$ of the waveform component that possesses the first band divided waveform is a frequency band that is fs/2 or less and fs/4 or more and the sampling frequency $f_1$ of the waveform data that express the first band divided waveform is equal to the sampling frequency fs. The frequency band $B_2$ of the waveform component that possesses the second band divided waveform is a frequency band that is fs/4 or less and fs/8 or more and the sampling frequency $f_2$ of the waveform data that express the first band divided waveform is one half the frequency of the sampling frequency fs. The frequency band of the waveform component that possesses the third band divided waveform is a frequency band that is fs/8 or less and the sampling frequency $f_3$ of the waveform data that express the first band divided waveform is one quarter the frequency of the sampling frequency fs.

Figure 7:
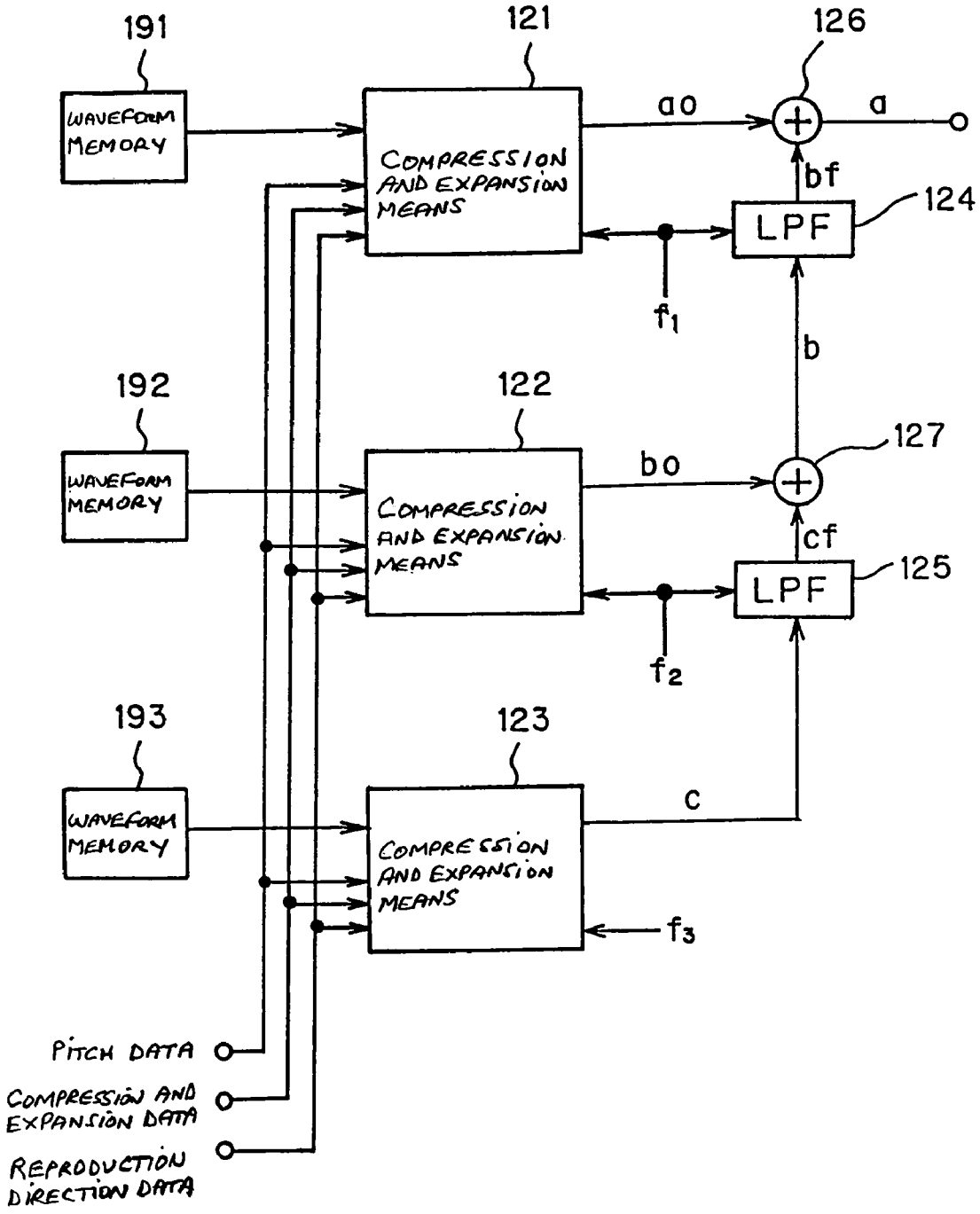
FIG. 7 is an equivalent circuit diagram to explain the operation with which the compressed and expanded original waveform is formed in accordance with the first preferred embodiment.

FIG. 7 is an equivalent circuit diagram to explain the operation with which the compressed and expanded original waveform is formed in accordance with the first preferred embodiment.

The three waveform memories 191, 192 and 193 are shown in this equivalent circuit diagram and here, the divided waveform data that express the first, second and third band divided waveforms that are shown in FIG. 5 are respectively stored in the waveform memories 191, 192 and 193. The three waveform memories 191, 192 and 193 represent the role of the second RAM 19 that is shown in FIG. 4.

In addition, the three compression and expansion means 121, 122 and 123 are shown in this equivalent circuit diagram and the compression and expansion means that is described in the present invention comprises these three compression and expansion means 121, 122 and 123. The first, second and third band divided waveforms are respectively compressed or expanded in the direction of the temporal axis by the compression and expansion means 121, 122 and 123 and the output ao, output bo and output c are respectively produced. As has been discussed above, the divided waveform data that express the first, second and third band divided waveforms which are shown in FIG. 5 are stored in the three waveform memories 191, 192 and 193 and the type of waveform of the first band divided waveform is different from those of the second and third band divided waveforms. Because of this, in this preferred embodiment, the second compression and expansion format that was discussed above is employed for the compression and expansion means 121 and the third compression and expansion format that was described above is employed for the compression and expansion means 122 and 123. The compression and expansion processing by each of the compression and expansion means 121, 122 and 123 is carried out with a processing period that corresponds respectively to the sampling frequencies $f_1$, $f_2$ and $f_3$. The pitch data that indicate the rate of change of the pitches of each of the band divided waveforms, the compression and expansion data that indicate the amount of compression and expansion of the waveforms and the reproduction direction data that designate the timing of the start of sound generation and the timing of the termination of sound generation are input into each of the compression and expansion means 121, 122 and 123. The pitch data, the compression and expansion data and the reproduction direction data are produced by the CPU 11 in conformance with the MIDI signals that have been input via the MIDI interface 15 that is shown in FIG. 4 and sent to the DSP 12.

In addition, the first low pass filter 124, the second low pass filter 125 and the addition circuits 126 and 127 are shown in this equivalent circuit diagram and the superimposing means that is described in the present invention comprises these. Furthermore, the compression and expansion means 121, 122 and 123, the low pass filters 124 and 125 and the addition circuits 126 and 127 express the working of the DSP 12 that is shown in FIG. 4.

The second low pass filter 125 is a filter with which the waveform components that have a frequency of $f_3/2$ (equals fs/8) or above are eliminated. In the second low pass filter 125, by means of the input of the output c from the third compression and expansion means 123, which is equivalent to the compressed and expanded waveform that is a compression and expansion of the third band divided waveform, sampling from the sampling frequency $f_3$ (equals fs/4) to the sampling frequency $f_2$ (equals fs/2), so-called oversampling, is executed and the output cf, which has the sampling frequency $f_2$, is produced. Following that, the output cf is added by the addition circuit 127 to the output bo from the second compression and expansion means 122, which is equivalent to the compressed and expanded waveform that is a compression and expansion of the second band divided waveform, and the output b is produced.

The first low pass filter 124 is a filter with which the waveform components that have a frequency of $f_2/2$ (equals fs/4) or above are eliminated. In the first low pass filter 124, by means of the input of the output b, oversampling from the sampling frequency $f_2$ (equals fs/2) to the sampling frequency f, (equals fs) is executed and the output bf, which has the sampling frequency $f_1$, is produced. Following that, the output bf is added by the addition circuit 126 to the output ao from the first compression and expansion means 121, which is equivalent to the compressed and expanded waveform that is a compression and expansion of the first band, divided waveform, and the output a is produced.

Figure 8:
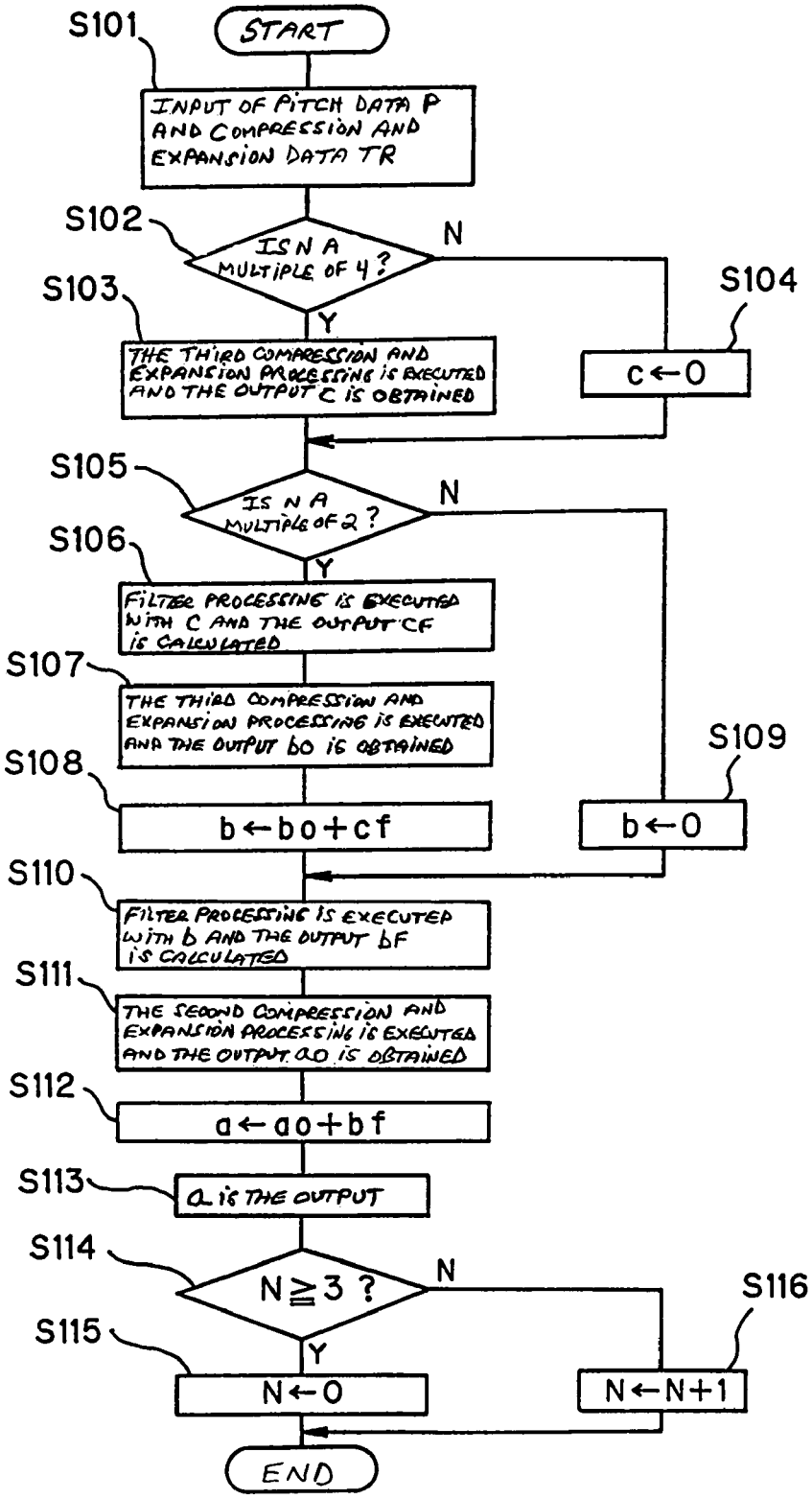
FIG. 8 is a flowchart that shows the operation of the first preferred embodiment.

FIG. 8 is a flowchart that shows the operation of the first preferred embodiment.

This flowchart is the flowchart for the execution in the DSP 12 that is shown in FIG. 4 of an operation that is equivalent to the operation for which an explanation was given using FIG. 7.

The operation that is expressed by this flowchart is repetitively executed at the sampling frequency $f_1$ (equals fs). Step S103, which will be explained below, is repetitively executed at the sampling frequency $f_3$ (equals fs/4) and Step S106 through Step S108, which will be explained below, are repetitively executed at the sampling frequency $f_2$ (equals fs/2).

When the operation that is expressed by this flowchart is begun, first, in Step S101, the pitch data P and the compression and expansion data TR are input from the CPU.

Following that, in Step S102 through Step S104, the output c is produced.

First it proceeds to Step S102 and a determination is made as to whether or not the value of the control variable N with which the counter for the repetitions of the operations that are indicated by this flowchart is advanced is a multiple of 4. If it is determined that the value of the variable N is a multiple of 4, it proceeds to Step S103, the third compression and expansion processing that is shown in FIG. 3 is executed with the waveform data that express the third band divided waveform and the output c is produced. When a determination is made that the value of the variable N is not a multiple of 4, it proceeds to Step S104 and the value of the output c is made "0." Following that, in Step S105 through Step S109, the output b is produced.

First it proceeds to Step S105 and a determination is made as to whether or not the value of the control variable N is a multiple of 2. If it is determined that the value of the variable N is a multiple of 2, it proceeds to Step S106, filter processing is executed with the output c and the output cf is produced. Next it proceeds to Step S107, the third compression and expansion processing is executed with the waveform data that express the second band divided waveform based on the pitch data P and the compression and expansion data TR and the output bo is produced. Next it proceeds to Step S108, output bo and output cf are added and the output b is produced. In the case where it has been determined in Step S105 that the value of the variable N is not a multiple of 2, it proceeds to Step S109 and the value of the output b is made "0."

Following that, the output a is produced in Step S110 through S112.

First it proceeds to Step S110, filter processing is executed with the output b and the output bf is produced. Next it proceeds to Step S1, the second compression and expansion processing that is shown in FIG. 2 is executed with the waveform data that express the first band divided waveform based on the pitch data P and the compression and expansion data TR and the output ao is produced. Next it proceeds to Step S112, the output ao and the output bf are added and the output a is produced.

Following that, it proceeds to Step S113 and the output a is output through the D/A converter 18 that is shown in FIG. 4.

Following that, in Step S114 through Step S116, it advances so that the value of the control variable N changes cyclicly in a range of a value of "0" through a value of "3" and terminates.

The second preferred embodiment of the waveform compression and expansion apparatus of the present invention is a system in which a multiple number of time divided waveforms which comprise an original waveform that expresses a musical tone etc. that has been divided into a multiple number of temporal regions are apportioned to a multiple number compression and expansion processing formats and form compressed or expanded waveforms by means of compression or expansion in the direction of the temporal axis.

Since the hardware configuration of the second preferred embodiment is the same as the hardware configuration of the first preferred embodiment a duplicative explanation will be omitted.

Figure 9:
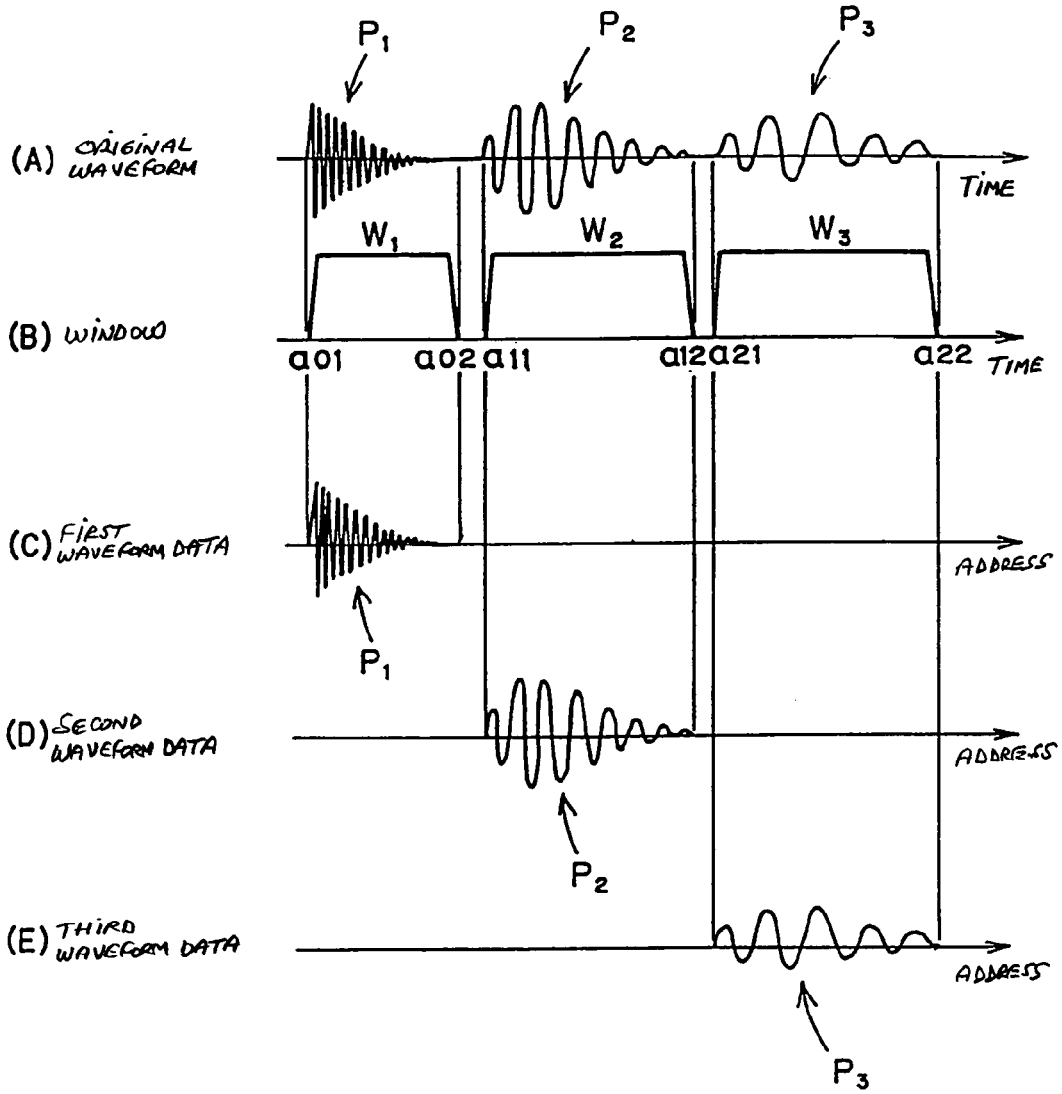
FIG. 9 is a diagram that shows one example of a time divided waveform according to an embodiment of the present invention.

FIG. 9 is a diagram that shows one example of a time divided waveform.

In FIG. 9(*a*), an example of an original waveform is shown and three kinds of waveform, $P_1$, $P_2$ and $P_3$, are contained in this original waveform. These waveforms $P_1$, $P_2$ and $P_3$ represent three sounds that have mutually different sound generation timings and pitches. These waveforms, $P_1$, $P_2$ and $P_3$, are each an example of a time divided waveform of the present invention. With regard to the compression and expansion processing formats with which these waveforms, $P_1$, $P_2$ and $P_3$ are compressed and expanded, the third compression and expansion processing format that was discussed above is suitable for the waveforms $P_1$ and $P_2$ and the first compression and expansion processing format that was discussed above is suitable for the waveform $P_3$. As will be discussed later, these compression and expansion processing formats are employed in this preferred embodiment.

In FIG. 9(*b*), the windows $W_1$, $W_2$ and $W_3$ that delimit the temporal regions are shown. The window W=delimits the temporal region from the time point a01 to the time point a02, the window $W_2$ delimits the temporal region from the time point a11 to the time point a12 and the window $W_3$ delimits the temporal region from the time point a21 to the time point a22.

In this preferred embodiment, the original waveform is divided in advance into a multiple number of band divided waveforms that each possess a multiple number of frequency band waveform components and compression and expansion processing that employs each of the compression and expansion formats is executed with the multiple number of band divided waveforms. In addition, the portions that correspond to the waveforms $P_1$, $P_2$ and $P_3$ are separated from the waveforms following the compression and expansion by the windows $W_1$, $W_2$ and $W_3$ that are shown in FIG. 9(*b*) and the specification of the compression and expansion processing formats is, in essence, done by this separation.

In FIG. 9(*c*), the band divided waveform that possesses the waveform component of the highest frequency band from among the multiple number of band divided waveforms is shown and the waveform $P_1$ from among the three kinds of waveforms $P_1$, $P_2$ and $P_3$ is primarily contained in this band divided waveform.

In FIG. 9(*d*), the band divided waveform that possesses the waveform component of the median frequency band from among the multiple number of band divided waveforms is shown and the waveform $P_2$ from among the three kinds of waveforms $P_1$, $P_2$ and $P_3$ is primarily contained in this band divided waveform.

In FIG. 9(*e*), the band divided waveform that possesses the waveform component of the lowest frequency band from among the multiple number of band divided waveforms is shown and the waveform $P_3$ from among the three kinds of waveforms $P_1$, $P_2$ and $P_3$ is primarily contained in this band divided waveform.

Actually, in FIG. 9(*c*), FIG. 9(*d*) and FIG. 9(*e*), only the portions that correspond to each of the waveforms $P_1$, $P_2$ and $P_3$ of each of the band divided waveforms are shown and these portions are separated by the windows $W_1$, $W_2$ and $W_3$ that are shown in FIG. 9(*b*). The horizontal axes of FIG. 9(*c*), FIG. 9(*d*) and FIG. 9(*e*) each represent a multiple number of band divided waveforms and, together with indicating the addresses of the first waveform data, the second waveform data and the third waveform data, they correspond to the temporal axes of each of the band divided waveforms. In this preferred embodiment, each band divided waveform is sampled at a sampling frequency that corresponds to the frequency band of the waveform component that each band divided waveform possesses and compression and expansion processing is executed with a processing period that corresponds to each sampling frequency. In this manner, each band divided waveform is compressed and expanded with good efficiency.

Figure 10:
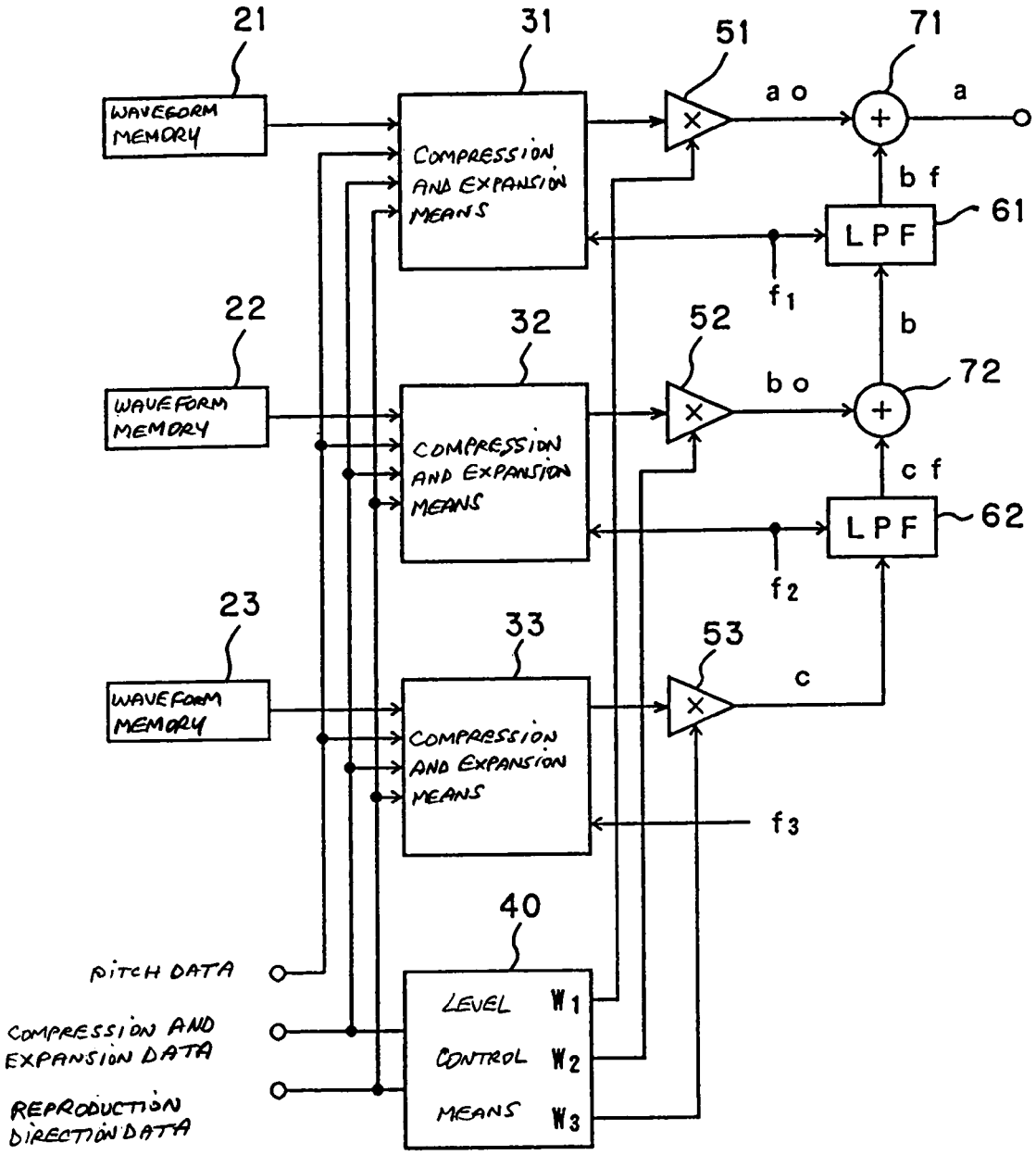
FIG. 10 is an equivalent circuit diagram to explain the operation with which the compressed and expanded original waveform is formed in accordance with the second preferred embodiment.

FIG. 10 is an equivalent circuit diagram to explain the operation with which the compressed and expanded original waveform is formed in accordance with the second preferred embodiment.

In this equivalent circuit, the three waveform memories 21, 22 and 23 are shown and the band divided waveforms that are shown in FIG. 9(*c*), FIG. 9(*d*) and FIG. 9(*e*) are respectively stored in these three waveform memories 21, 22 and 23. The three waveform memories 21, 22 and 23 represent the role of the second RAM 19 that is shown in FIG. 4.

In addition, the three compression and expansion means 31, 32 and 33 are shown in this equivalent circuit diagram and the compression and expansion means that is described in the present invention comprises these three compression and expansion means 31, 32 and 33. Each of the band divided waveforms that have been stored in each of the waveform memories 21, 22 and 23 is compressed or expanded in the direction of the temporal axis by the compression and expansion means 31, 32 and 33. In this preferred embodiment, the third compression and expansion processing format that has been discussed above is employed with the compression and expansion means 31 and 32 and the first compression and expansion processing format that has been discussed above is employed with the compression and expansion means 33. In addition, the compression and expansion processing by means of each of the compression and expansion means 31, 32 and 33 is carried out with a processing period that corresponds to the sampling frequencies $f_1$, $f_2$ and $f_3$ of each of the band divided waveforms and, here, the sampling frequencies $f_1$, $f_2$ and $f_3$ are in a relationship where $f_3=f_2/2\ f_1/4$. In addition, pitch data, compression and expansion data and reproduction direction data are input to each of the compression and expansion means 32, 32 and 33. The pitch data indicate the rate of change of the pitch of each band divided waveform, the compression and expansion data indicate the amount of compression and expansion of the waveform and the reproduction direction data indicate the timing with which the sound generation is started and the timing with which the sound generation is terminated. In addition, the pitch data, the compression and expansion data and the reproduction direction data correspond to the MIDI signals that are input via the MIDI interface 15 shown in FIG. 4. They are produced by the CPU 11 and sent to the DSP 12.

In addition, in this equivalent circuit, the level control means 40 and the multiplication circuits 51, 52 and 53 are shown. Each of the processing format specification means in the present invention comprise these. The levels of the windows $W_1$, $W_2$ and $W_3$ are controlled by the level control means 40 and the signals that indicate the levels are input to the multiplication circuits 51, 52 and 53. The levels of each of the windows $W_1$, $W_2$ and $W_3$ and the outputs of each of the compression and expansion means 31, 32 and 33 are mated and, by this means, from the outputs of each of the compression and expansion means 31, 32 and 33, the portions that correspond to each of the waveforms $P_1$, $P_2$ and $P_3$ that are shown in FIG. 5(*a*) are separated and the outputs ao, bo and c are produced. The specification of the compression and expansion processing formats that are employed in each of the compression and expansion means 31, 32 and 33 as the formats for the compression and expansion of each of the waveforms $P_1$, $P_2$ and P3 is, in essence, done by means of this separation.

In addition, in this equivalent circuit, the first low pass filter 61, the second low pass filter 62 and the addition circuits 71 and 72 are shown. The compression and expansion means 31, 32 and 33, the multiplication circuits 51, 52 and 53, the low pass filters 61 and 62 and the addition circuits 71 and 72 represent the action of the DSP 12 that is shown in FIG. 4.

The output c is input to the second low pass filter 62 and so-called oversampling is executed with the output c by the second low pass filter 62 from the sampling frequency $f_3$ to the sampling frequency $f_2$. The output cf is produced with the sampling frequency of $f_2$. Following that, the output cf is added to the output bo by the addition circuit 72 and the output b is produced.

The output b is input to the first low pass filter and oversampling is executed with the output b from the sampling frequency $f_2$ to the sampling frequency $f_1$. The output bf is produced with the sampling frequency of $f_1$. Following that, the output bf is added to the output ao by the addition circuit 71 and the output a, which corresponds to the waveform that is the original waveform which has been compressed and expanded, is produced.

Since, in the manner that has been discussed above, the compression and expansion processing formats that are suitable to the type of waveform are employed in each of the compression and expansion means 31, 32 and 33, the sound quality of the sound that the output a represents is satisfactory.

Figure 11:
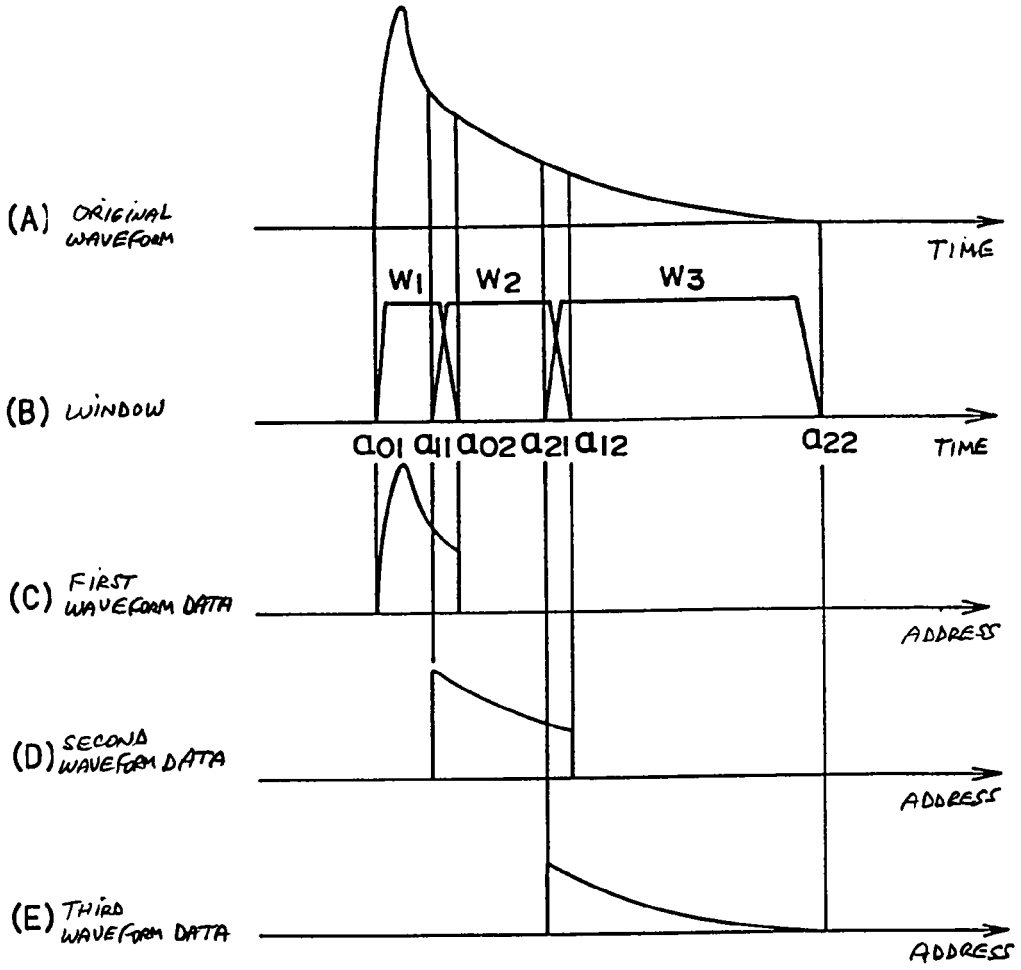
FIG. 11 is a diagram that shows another example of a time divided waveform which is different from the example of a time divided waveform that is shown in FIG. 9 according to an embodiment of the present invention.

FIG. 11 is a diagram that shows another example of a time divided waveform which is different from the example of a time divided waveform that is shown in FIG. 9.

In FIG. 11(*a*), another example of an original waveform, which is different from the example of an original waveform that is shown in FIG. 9(*a*), is shown and the frequency of this original waveform changes continuously from a high frequency to a low frequency together with the passage of time. Actually, only the envelope of the original waveform is shown in FIG. 11(*a*) and the waveform itself is omitted from the drawing. The example of FIG. 11 is typically encountered during the attack portion of a musical sound such as a drum, voice, or musical instrument. In preferred embodiments, the initial attack as designated by window W1 is not looped in the compression or expansion processing format, but subsequent temporal regions designated by windows $W_2$ and $W_3$ may be looped.

The windows $W_1$, $W_2$ and $W_3$ are shown in FIG. 11(B) and, the same as the windows $W_1$, $W_2$ and $W_3$ that are shown in FIG. 9(*b*), the window $W_1$ delimits the temporal region from the time point a01 to the time point a02, the window $W_2$ delimits the temporal region from the time point a 1 to the time point a12 and the window $W_3$ delimits the temporal region from the time point a21 to the time point a22. However, differing from FIG. 9(*b*), in FIG. 11(*b*), the time point all is a time point that is prior to the time point a02 and, between the time point a11 and the time point a02, the window $W_1$ and the window $W_2$ produce so-called cross fading. In the same manner, the time point a21 is a time point that is prior to the time point a12 and, between the time point a21 and the time point a12, the window $W_2$ and the window $W_3$ produce cross fading.

In the same manner as in FIG. 9(*c*), FIG. 9(*d*) and FIG. 9(*e*), in FIG. 11(*c*), FIG. 11(*d*) and FIG. 11(*e*), a multiple number of band divided waveforms are shown that comprise the multiple number of waveform components of the frequency bands into which the original waveform has been divided. However, as has been discussed above, since the frequency of the original waveform changes together with the passage of time, here, the envelopes of the portions in which each of the band divided waveforms are primarily contained from among the original waveforms that are shown in FIG. 7(*a*) have been shown. These portions are examples of divided waveforms of the present invention and these portions are separated from the original waveform by the windows $W_1$, $W_2$ and $W_3$ that are shown in FIG. 7(*b*).

Each of the band divided waveforms is sampled with each of the sampling frequencies $f_1$, $f_2$ and $f_3$ and the first waveform data, the second waveform data and the third waveform data are stored in each of the waveform memories 21, 22 and 23 that are shown in FIG. 10.

Figure 12:
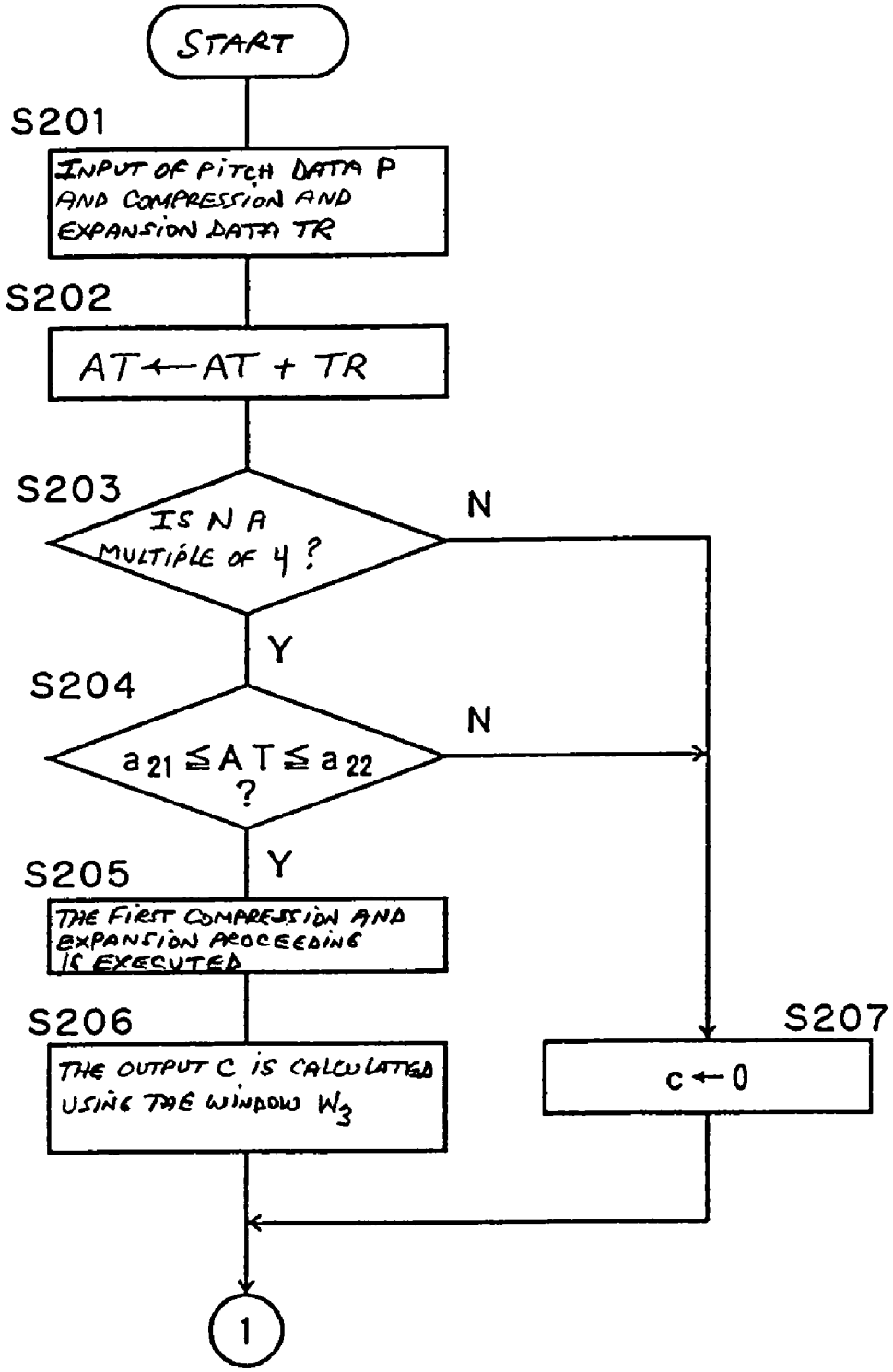
FIG. 12 is the first part of a flowchart that shows the operation of the second preferred embodiment.
Figure 13:
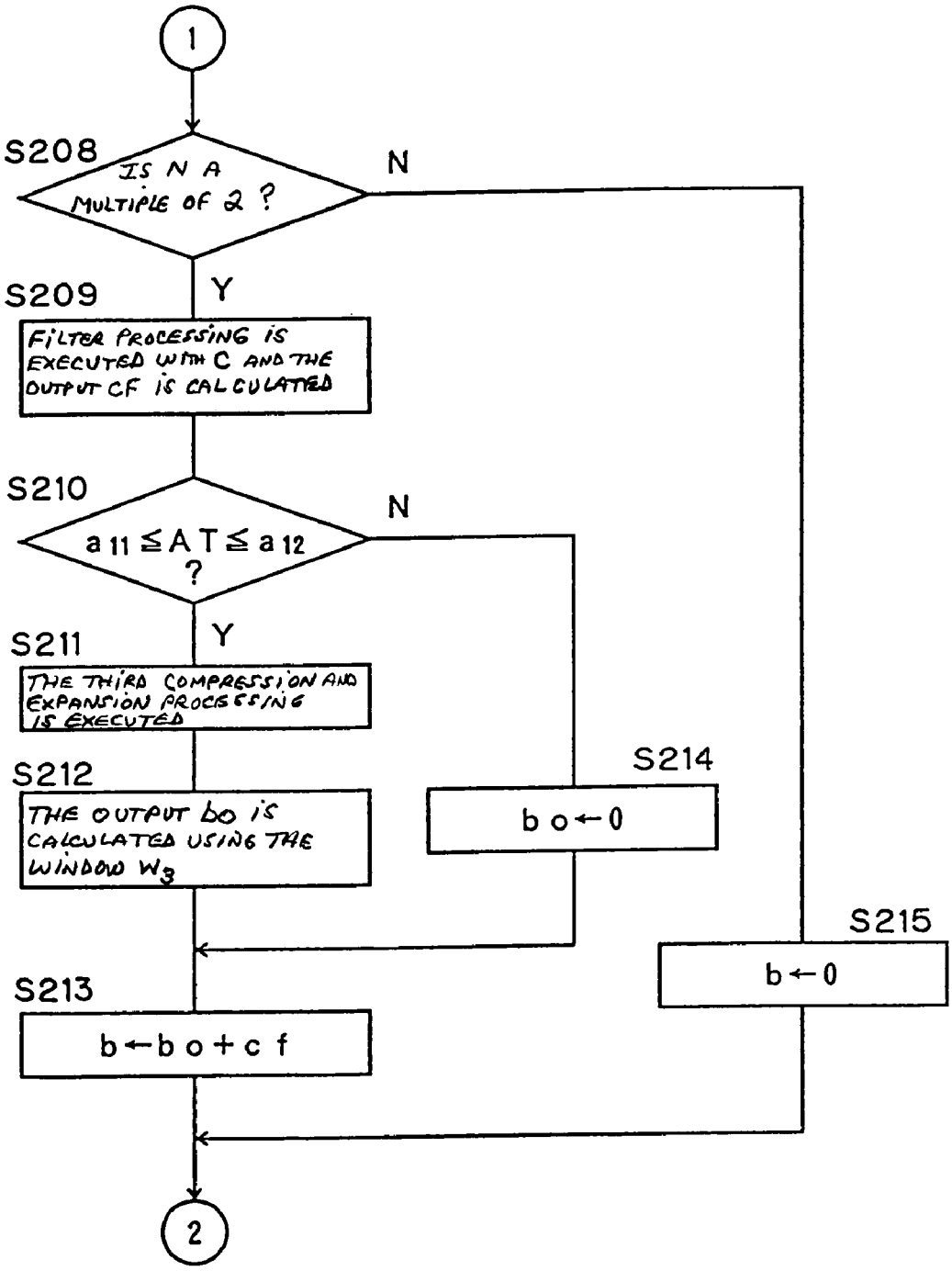
FIG. 13 is the second part of a flowchart that shows the operation of the second preferred embodiment.
Figure 14:
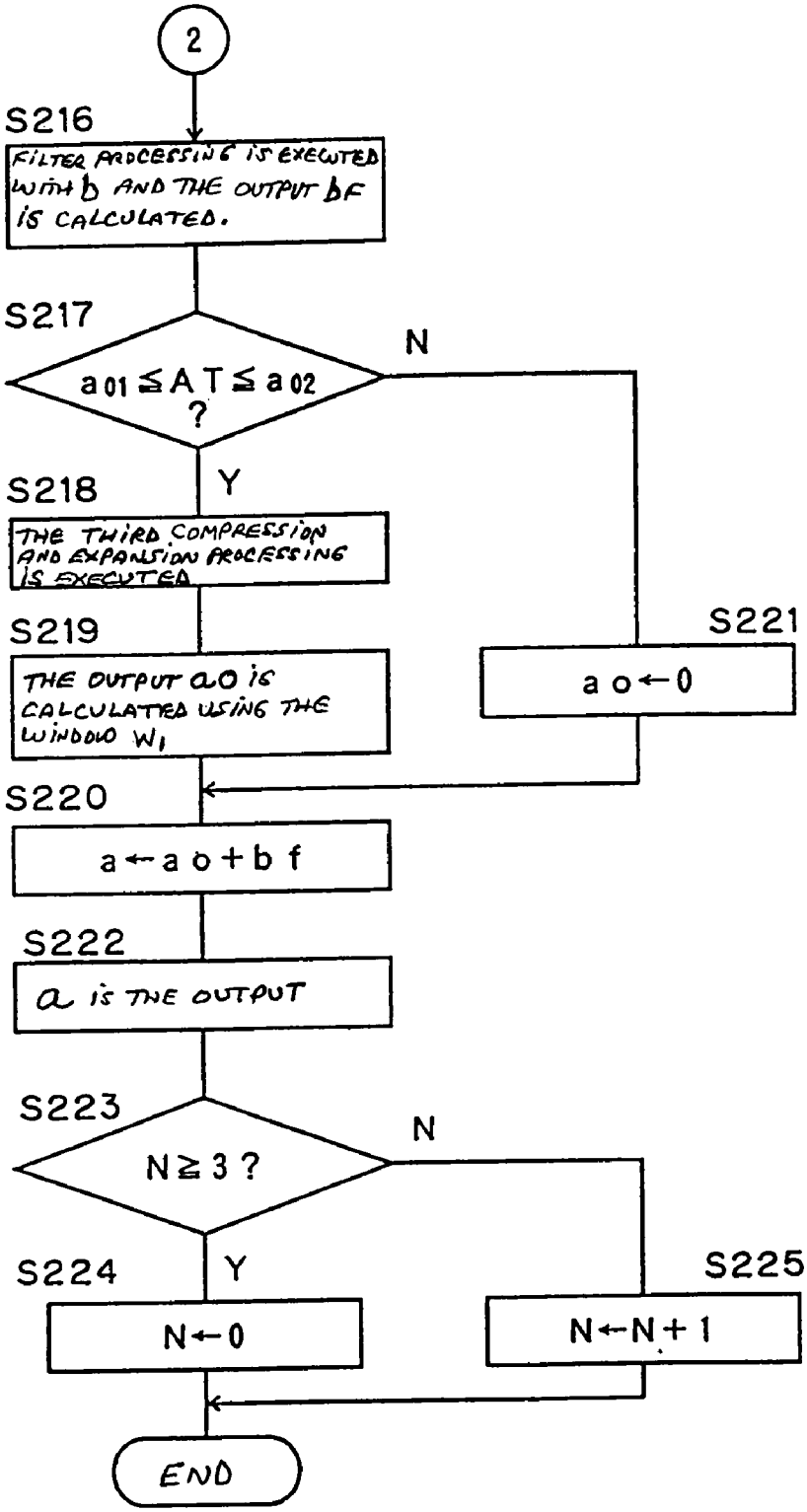
FIG. 14 is the third part of a flowchart that shows the operation of the second preferred embodiment.

FIG. 12, FIG. 13 and FIG. 14 are flowcharts that show the operation of the second preferred embodiment.

This flowchart is a flowchart for the purpose of running the operation using FIG. 11 and an equivalent operation in the DSP 12 that is shown in FIG. 4.

The program flow continues from Step S206 or Step S207 of FIG. 12 to Step S208 of FIG. 13, and the program flow also continues from Step S213 or Step S215 of FIG. 13 to Step S216 of FIG. 14.

The operation that is expressed by this flowchart is executed repeatedly with the sampling frequency $f_1$. Step S204 through Step S206, which will be explained below, are executed repeatedly with the sampling frequency $f_3$ and Step S209 through Step S214, which will be explained below, are executed repeatedly with the sampling frequency $f_2$.

When the operation that is expressed by this flowchart is started, first, in Step S201, the pitch data P and the compression and expansion data TR are input from the CPU, it proceeds to Step S202 and the variable AT, which indicates the time point on the temporal axis that is shown in FIG. 9(*b*) and FIG. 11(*b*), is advanced by the compression and expansion data TR.

Following that, the output c is calculated in Step S203 through Step S207.

First it proceeds to Step S203 and a determination is made as to whether or not the value of the control variable N, with which the counter for the repetitions of the operations that are indicated by this flowchart is advanced, is a multiple of 4. If it is determined that the value of the variable N is a multiple of 4, it proceeds to Step S204 and a determination is made as to whether or not the time point that represents the variable AT is a time point that is between the time point a21 and the time point a22, in other words, a determination is made as to whether or not the time point that represents the variable AT exists in the temporal region that is delimited by the window $W_3$. If it is determined that it exists in the temporal region, it proceeds to Step S205, the first compression and expansion processing that is shown in FIG. 1 is executed with the third waveform data based on the pitch data P and the compression and expansion data TR, it proceeds to Step S206, the value of the waveform data for which the compression and expansion processing was executed in Step S205 and the level of the window $W_3$ at the time point that represents the variable AT are matched and the output c is calculated. In the case where, in Step S203, it has been determined that the variable N is not a multiple of 4, and in the case where, in Step S204, it has been determined that the time point that represents the variable AT exists outside the temporal region that is delimited by the window $W_3$, the output c is made a value of "0."

Following that, the output b is calculated in Step S208 through Step S215.

First it proceeds to Step S208 and a determination is made as to whether or not the value of the control variable N is a multiple of 2. If it is determined that the value of the variable N is a multiple of 2, it proceeds to Step S209, filter processing is executed with the output c and the output cf is produced. Next, it proceeds to Step S210 and a determination is made as to whether or not the time point that represents the variable AT is a time point between the time point a11 and the time point a12, in other words, a determination is made as to whether or not the time point that represents the variable AT exists in the temporal region that is delimited by the window $W_2$. If it is determined that it exists in the temporal region that is delimited by the window $W_2$, it proceeds to Step S211, the third compression and expansion processing that is shown in FIG. 3 is executed with the second waveform data based on the pitch data P and the compression and expansion data TR, it proceeds to Step S212, the value of the waveform data for which the compression and expansion processing was executed in Step S211 and the level of the window $W_2$ at the time point that represents the variable AT are mated and the output bo is calculated. Next, it proceeds to Step S213, the output bo and the output cf are multiplied and the output b is calculated.

In the case, in Step S210, where it has been determined that the time point that represents the variable AT exists outside the temporal region that is delimited by the window $W_2$, it proceeds to Step S214 and the output bo becomes a value of "0." It then proceeds to Step S213 the output bo (here it is a value of "0") and the output cf are added and the output b is calculated.

In the case where, in Step S208, it has been determined that the value of the variable N is not a multiple of 2, it proceeds to Step S215 and the output b becomes a value of "0."

Following that, the output a is produced in Step S216 through Step S221.

First it proceeds to Step S216, filter processing is executed with the output b and the output a is produced. Next, it proceeds to Step S217 and a determination is made as to whether or not the time point that represents the variable AT is a time point that is between the time point a01 and the time point a02, in other words, a determination is made as to whether or not the time point that represents the variable AT exists in the temporal region that is delimited by the window $W_1$. If a determination is made that it exists in the temporal region that is delimited by the window $W_1$, it proceeds to Step S218 and the third compression and expansion processing is executed with the first waveform data based on the pitch data P and the compression and expansion data TR. It then proceeds to Step S219, the value of the waveform data for which the compression and expansion processing has been executed and the level of the window $W_1$ at the time point that represents the variable AT are matched and the output ao is calculated. Next, it proceeds to Step S220, the output ao and the output bf are added and the output a is calculated.

In the case where, in Step S217, it has been determined that the time point that represents the variable AT exists outside the temporal region that is delimited by the window $W_1$, it proceeds to Step S221 and the output ao becomes a value of "0." It then proceeds to Step S220, the output ao (here it is a value of "0") and the output bf are added and the output a is calculated.

Following that, it proceeds to Step S222 and the output a is output via the D/A converter 18 that is shown in FIG. 4.

Following that, in Step S223 through Step S225, it advances so that the value of the control variable N is cyclicly changed in the range of a value of "0" through a value of "3" and terminates.

Incidentally, in each of the preferred embodiments that have been discussed above, waveform data that express a multiple number of waveforms in which the original waveform has been band divided have been input to a multiple number of compression and expansion means but, in the waveform compression and expansion apparatus of the present invention, it is also satisfactory if it is set up so that waveform data that express the original waveform are input to all of the multiple number of compression and expansion means.

In addition, in the second preferred embodiment that was discussed above, the specification of the compression and expansion formats is, in essence, carried out by the separation of the portions from the outputs of a multiple number of compression and expansion means that correspond to each of the multiple number of divided waveforms that comprise the original waveform which has been divided into a multiple number of temporal regions. However, the processing format specification means of the present invention may also be one in which a multiple number of divided waveforms are divided among and input to a multiple number of compression and expansion means.

Furthermore, in the second preferred embodiment that was discussed above, the compression and expansion processing formats of each of the compression and expansion means are fixed, however, in the waveform compression and expansion apparatus of the present invention, the compression and expansion processing formats of each of the compression and expansion means may be ones that change together with the passage of time.

What is claimed is:

1. A method for generating a compressed or expanded waveform from original waveform data, said generated compressed or expanded waveform capable of being stored or reproduced, the method comprising the steps of:

frequency band-dividing the original waveform data to produce a plurality of frequency band-divided waveforms;

receiving position data including a plurality of time points indicating when waveform data is to be read out from the plurality of frequency band-divided waveforms, and position information elements indicating a particular location in the plurality of frequency band-divided waveforms corresponding to each time point;

generating at least one processed waveform from each frequency band-divided waveform according to the position data and at least one compression and expansion format; and superimposing a plurality of processed waveforms generated from all frequency band-divided waveforms to form the compressed or expanded waveform;

wherein in accordance with a first compression and expansion format, the step of generating at least one processed waveform from each frequency band-divided waveform further includes the steps of:

receiving a plurality of opening and starting addresses, each opening and starting address designating a starting point of cycles that comprise the frequency band-divided waveform;

receiving a plurality of position information elements, each position information element designating a particular cycle and address of the frequency band-divided waveform corresponding to each time point;

reading out first waveform data from the frequency band-divided waveform of at least two repeated cycles starting at the opening and starting address associated with the cycle corresponding to every other time point, and waveshaping the first waveform data with an envelope to form a first processed waveform; and reading out second waveform data from the frequency band-divided waveform of at least two repeated cycles starting at the opening and starting address associated with the cycle corresponding to every other time point that does not coincide with the reading out of the first waveform data, and waveshaping the second waveform data with the envelope to form a second processed waveform.

2. A method as recited in claim 1, further including the step of repetitively reading out cycles within the first and second waveform data when a first interval between addresses designated by the plurality of position information elements is less than a second interval between addresses in the plurality of opening and starting addresses.

3. A method as recited in claim 1, further including the step of jump reading out cycles within the first and second waveform data when a first interval between addresses designated by the plurality of position information elements is greater than a second interval between addresses in the plurality of opening and starting addresses.

4. A method for generating a compressed or expanded waveform from original waveform data, said generated compressed or expanded waveform of being stored or reproduced, the method comprising the steps of:

frequency band-dividing the original waveform data to produce a plurality of frequency band-divided waveforms;

receiving position data including a plurality of time points indicating when waveform data is to be read out from the plurality of frequency band-divided waveforms, and position information elements indicating a particular location in the plurality of frequency band-divided waveforms corresponding to each time point;

generating at least one processed waveform from each frequency band-divided waveform according to the position data and at least one compression and expansion format; and superimposing a plurality of processed waveforms generated from all frequency band-divided waveforms to form the compressed or expanded waveform;

wherein the step of generating at least one processed waveform from each frequency band-divided waveform further includes the steps of:

receiving a plurality of position information elements, each position information element designating a different address of the frequency band-divided waveform corresponding to each time point;

receiving pitch data indicating a read-out speed of the waveform portions;

reading out successive first waveform portions from the frequency band-divided waveform at the read-out speed at every other time point, each first waveform portion comprising waveform data starting at the address of the position information element corresponding to the time point, the successive first waveform portions comprising first read-out waveform data;

reading out successive second waveform portions from the frequency band-divided waveform at the read-out speed at every other time point that does not coincide with the reading out of successive first waveform portions, each second waveform portion comprising waveform data starting at the address of the position information element corresponding to the time point, the successive second waveform portions comprising second read-out waveform data;

waveshaping the first read-out waveform data with an envelope to form a first processed waveform; and waveshaping the second read-out waveform data with the envelope to form a second processed waveform.

5. A method as recited in claim 4, further including the step of repetitively reading out first and second waveform portions when each read-out start point associated with each position information element is earlier in time than the time point corresponding to the position information element.

6. A method as recited in claim 4, further including the step of jump reading out first and second waveform portions when each read-out start point associated with each position information element is later in time than the time point corresponding to the position information element.

7. A method for generating a compressed or expanded waveform from original waveform data, said generated compressed or expanded waveform capable of being stored or reproduced, the method comprising the steps of:

frequency band-dividing the original waveform data to produce a plurality of frequency band-divided waveforms;

receiving position data including a plurality of time points indicating when waveform data is to be read out from the plurality of frequency band-divided waveforms, and position information elements indicating a particular location in the plurality of frequency band-divided waveforms corresponding to each time point;

generating at least one processed waveform from each frequency band-divided waveform according to the position data and at least one compression and expansion format; and superimposing a plurality of processed waveforms generated from all frequency band-divided waveforms to form the compressed or expanded waveform;

wherein the step of generating at least one processed waveform from each frequency band-divided waveform further includes the steps of:

receiving a plurality of mark addresses that designate a starting point at delimiting locations of waveform segments of the frequency band-divided waveform;

receiving a plurality of position information elements indicating a particular waveform segment of the frequency band-divided waveform corresponding to each time point;

receiving pitch data indicating a read-out speed of the waveform portions; reading out portions of at least one waveform segment at the read-out speed at every time point of the frequency band-divided waveform, the portions of at least one waveform segment comprising waveform data starting at the mark address associated with the waveform segment corresponding to the time point and ending with a mark address corresponding to a subsequent time point; and sequencing consecutive portions of at least one waveform segment to generate a processed waveform from the frequency band-divided waveform.

8. A method as recited in claim 7, further including the step of repetitively reading out portions of at least one waveform segment when a first interval between addresses designated by the plurality of position information elements is less than a second interval between addresses in the plurality of mark addresses.

9. A method as recited in claim 7, further including the step of jump reading out portions of at least one waveform segment when a first interval between addresses designated by the plurality of position information elements is greater than a second interval between addresses in the plurality of mark addresses.

10. The method of claim 7, wherein the delimiting location is a zero-crossing.

11. The method of claim 7, wherein the delimiting location is an energy peak.

12. A method for generating a compressed or expanded waveform from original waveform data, said generated compressed or expanded waveform capable of being stored or reproduced, the method comprising the steps of:

frequency band-dividing the original waveform data to produce a plurality of frequency band-divided waveforms;

receiving position data including a plurality of time points indicating when waveform data is to be read out from the plurality of frequency band-divided waveforms, and position information elements indicating a particular location in the plurality of frequency band-divided waveforms corresponding to each time point;

generating at least one processed waveform from each frequency band-divided waveform according to the position data and at least one compression and expansion format;

superimposing a plurality of processed waveforms generated from all frequency band-divided waveforms to form the compressed or expanded waveform; and compressing or expanding each processed waveform by an identical amount of time;

wherein the step of frequency band-dividing the original waveform data further including the steps of:

sampling the original waveform data at a sampling frequency $F_S$; and dividing the original waveform data into N frequency band-divided waveforms, wherein the Mth frequency band-divided waveform, where M is an integer varying from one to N, is sampled at a sampling frequency equal to $F_S$ divided by $2^{(M-1)}$, and has a frequency band ranging from Fs divided by $2^{(M+1)}$ to $F_S$ divided by $2^{(M)}$.

13. A method as recited in claim 12, the step of superimposing a plurality of processed waveforms comprising the steps of:

filtering at least one of the N processed waveforms generated from the N frequency band-divided waveforms according to the frequency band of the frequency band-divided waveform associated with each processed waveform; and summing the N processed waveforms to form the compressed or expanded waveforms.

14. A method as recited in claim 13, the step of frequency band-dividing the original waveform data further including the steps of:

dividing the original waveform data into three frequency band-divided waveforms;

generating at least one processed waveform from the first frequency band-divided waveform in accordance with a second compression and expansion format comprising the steps of receiving a plurality of position information elements, each position information element designating a different address of the frequency band-divided waveform corresponding to each time point, receiving pitch data indicating a read-out speed of the waveform portions, reading out successive first waveform portions from the frequency band-divided waveform at the read-out speed at every other time point, each first waveform portion comprising waveform data starting at the address of the position information element corresponding to the time point, the successive first waveform portions comprising first read-out waveform data, reading out successive second waveform portions from the frequency band-divided waveform at the read-out speed at every other time point that does not coincide with the reading out of successive first waveform portions, each second waveform portion comprising waveform data starting at the address of the position information element corresponding to the time point, the successive second waveform portions comprising second read-out waveform data, waveshaping the first read-out waveform data with an envelope to form a first processed waveform, and waveshaping the second read-out waveform data with the envelope to form a second processed waveform; and generating at least one processed waveform from the second and third frequency band-divided waveforms in accordance with a third compression and expansion format comprising the steps of receiving a plurality of mark addresses that designate a starting point at zero-crossings of waveform segments of the frequency band-divided waveform, receiving a plurality of position information elements indicating a particular waveform segment of the frequency band-divided waveform corresponding to each time point, receiving pitch data indicating a read-out speed of the waveform portions, reading out portions of at least one waveform segment at the read-out speed at every time point of the frequency band-divided waveform, the portions of at least one waveform segment comprising waveform data starting at the mark address associated with the waveform segment corresponding to the time point, and sequencing consecutive portions of at least one waveform segment to generate a processed waveform from the frequency band-divided waveform.

15. A method as recited in claim 14, the step of superimposing a plurality of processed waveforms further including the steps of:

sampling and low-pass filtering the processed waveform generated from the third frequency band-divided waveform according to the sampling frequency associated with the second frequency band-divided waveform and frequency band associated with the third frequency band-divided waveform to generate a third intermediate processed waveform;

summing the third intermediate processed waveform with the at least one processed waveform generated from the second frequency band-divided waveform to generate a second intermediate processed waveform;

sampling and low-pass filtering the second intermediate processed waveform according to the sampling frequency associated with the first frequency band-divided waveform and frequency band associated with the second and third frequency band-divided waveforms to generate a first intermediate processed waveform; and summing the first intermediate processed waveform with the at least one processed waveform generated from the first frequency band-divided waveform to form the compressed or expanded waveform.

16. A method for generating a compressed or expanded waveform from original waveform data, said generated compressed or expanded waveform capable of being stored or reproduced, the method comprising the steps of:

frequency band-dividing the original waveform data to produce a plurality of frequency band-divided waveforms;

receiving position data including a plurality of time points indicating when waveform data is to be read out from the plurality of frequency band-divided waveforms, and position information elements indicating a particular location in the plurality of frequency band-divided waveforms corresponding to each time point;

generating at least one processed waveform from each frequency band-divided waveform according to the position data and at least one compression and expansion format; and superimposing a plurality of processed waveforms generated from all frequency band-divided waveforms to form the compressed or expanded waveform;

wherein the step of frequency band-dividing the original waveform data further includes the steps of dividing the original waveform data into a plurality of frequency band-divided waveforms, each frequency band-divided waveform having a plurality of frequency band waveform components;

receiving a plurality of mark addresses that designate a starting point at delimiting locations of waveform segments of the frequency band-divided waveform;

receiving a plurality of position information elements indicating a particular waveform segment of the frequency band-divided waveform corresponding to each time point;

receiving pitch data indicating a read-out speed of the waveform portions;

reading out portions of at least one waveform segment at the read-out speed at every time point of the frequency band-divided waveform, the portions of at least one waveform segment comprising waveform data starting at the mark address associated with the waveform segment corresponding to the time point and ending with a mark address corresponding to a subsequent time point; and sequencing consecutive portions of at least one waveform segment to generate a processed waveform from the frequency band-divided waveform; and wherein the step of superimposing a plurality of processed waveforms comprising the steps of:

multiplying each processed waveform with a level-controllable time window;

filtering at least one of the plurality of processed waveforms generated from the plurality of frequency band-divided waveforms according to a frequency band of the frequency band-divided waveform associated with each processed waveform; and summing the processed waveforms to form the compressed or expanded waveforms.

17. The method of claim 16, wherein the delimiting location is a zero-crossing.

18. The method of claim 16, wherein the delimiting location is an energy peak.

19. A method for generating a compressed or expanded waveform from original waveform data, said generated compressed or expanded waveform capable of being stored or reproduced, the method comprising the steps of:

frequency band-dividing the original waveform data to produce a plurality of frequency band-divided waveforms;

receiving position data including a plurality of time points indicating when waveform data is to be read out from the plurality of frequency band-divided waveforms, and position information elements indicating a particular location in the plurality of frequency band-divided waveforms corresponding to each time point;

generating at least one processed waveform from each frequency band-divided waveform according to the position data and at least one compression and expansion format; and superimposing a plurality of processed waveforms generated from all frequency band-divided waveforms to form the compressed or expanded waveform;

wherein the step of frequency band-dividing the original waveform data further includes the steps of dividing the original waveform data into a plurality of frequency band-divided waveforms, each frequency band-divided waveform having a plurality of frequency band waveform components, the step of frequency band-dividing the original waveform data further including the steps of:

dividing the original waveform data into three frequency band-divided waveforms;

generating at least one processed waveform from the first and second frequency band-divided waveforms in accordance with a compression and expansion format comprising the steps of receiving a plurality of mark addresses that designate a starting point at zero-crossings of waveform segments of the frequency band-divided waveform, receiving a plurality of position information elements indicating a particular waveform segment of the frequency band-divided waveform corresponding to each time point, receiving pitch data indicating a read-out speed of the waveform portions, reading out portions of at least one waveform segment at the read-out speed at every time point of the frequency band-divided waveform, the portions of at least one waveform segment comprising waveform data starting at the mark address associated with the waveform segment corresponding to the time point, and sequencing consecutive portions of at least one waveform segment to generate a processed waveform from the frequency band-divided waveform; and generating at least one processed waveform from the third frequency band-divided waveform in accordance with a compression and expansion format comprising the steps of receiving a plurality of opening and starting addresses, each opening and starting address designating a starting point of cycles that comprise the frequency band-divided waveform, receiving a plurality of position information elements, each position information element designating a particular cycle and address of the frequency band-divided waveform corresponding to each time point, reading out first waveform data from the frequency band-divided waveform of at least two repeated cycles starting at the opening and starting address associated with the cycle corresponding to every other time point, and waveshaping the first waveform data with an envelope to form a first processed waveform, and reading out second waveform data from the frequency band-divided waveform of at least two repeated cycles starting at the opening and starting address associated with the cycle corresponding to every other time point that does not coincide with the reading out of the first waveform data, and waveshaping the second waveform data with the envelope to form a second processed waveform, wherein the step of superimposing a plurality of processed waveforms comprising the steps of:

multiplying each processed waveform with a level-controllable time window;

filtering at least one of the plurality of processed waveforms generated from the plurality of frequency band-divided waveforms according to a frequency band of the frequency band-divided waveform associated with each processed waveform; and summing the processed waveforms to form the compressed or expanded waveforms.

20. A method as recited in claim 19, the step of superimposing a plurality of processed waveforms further including the steps of:

sampling and low-pass filtering the processed waveform generated from the third frequency band-divided waveform according to the sampling frequency associated with the second frequency band-divided waveform and frequency band associated with the third frequency band-divided waveform to generate a third intermediate processed waveform;

summing the third intermediate processed waveform with the at least one processed waveform generated from the second frequency band-divided waveform to generate a second intermediate processed waveform;

sampling and low-pass filtering the second intermediate processed waveform according to the sampling frequency associated with the first frequency band-divided waveform and frequency band associated with the second and third frequency band-divided waveforms to generate a first intermediate processed waveform; and summing the first intermediate processed waveform with the at least one processed waveform generated from the first frequency band-divided waveform to form the compressed or expanded waveform.

21. A method as recited in claim 20, the step of superimposing a plurality of processed waveforms further including the step of establishing the time windows to produce cross-fading.

22. A waveform compression apparatus for compressing a plurality of frequency band-divided waveforms generated from an original waveform, each of the plurality of frequency band-divided waveforms comprising waveform components of a corresponding frequency band of a plurality of frequency bands, the apparatus comprising:

compression means with which each of the plurality of frequency band-divided waveforms is apportioned to a corresponding one of at least two different kinds of compression formats during compression, and each of the plurality of frequency band-divided waveforms is compressed in accordance with the corresponding compression format in a direction of a temporal axis to provide a corresponding compressed frequency band-divided waveform; and a superimposing means in which, by superimposing the plurality of compressed frequency band-divided waveforms, a resultant waveform that corresponds to the original waveform that has been compressed in the direction of the temporal axis is formed;

wherein said resultant waveform is capable of being stored or reproduced.

23. An apparatus as recited in claim 22, wherein each of the plurality of frequency band-divided waveform is generated from the original waveform by sampling the original waveform with a corresponding sampling frequency; and wherein the compression means executes compression processing for each frequency band-divided waveform of the plurality of frequency band-divided waveforms with a corresponding processing period that is based on the corresponding sampling frequency at which the original waveform was sampled to generate the frequency band-divided waveform.

24. The apparatus as recited in claim 22, wherein the compression means is configured to compress each of the plurality of frequency band-divided waveforms by an identical amount.

25. A waveform compression apparatus for compressing a plurality of temporally divided waveforms, comprising:

a processing format specification means in which a corresponding compression processing format of a plurality of compression processing formats is specified for each of the plurality of temporally divided waveforms during compression, said plurality of compression processing formats including at least two different compression processing formats, each of the at least two different compression processing formats for compressing waveforms; and a compression means in which compression processing is performed on each temporally divided waveform of the plurality of temporally divided waveforms to compress the temporally divided waveform in a direction of a temporal axis according to the specified corresponding compression processing format to provide a corresponding resultant temporally divided waveform that is capable of being stored or reproduced.

26. A waveform expansion apparatus for expanding a plurality of frequency band-divided waveforms generated from an original waveform, each of the plurality of frequency band-divided waveforms comprising waveform components of a corresponding frequency band of a plurality of frequency bands, the apparatus comprising:

expansion means with which each of the plurality of frequency band-divided waveforms is apportioned to a corresponding one of at least two different kinds of expansion formats during expansion, and each of the plurality of frequency band-divided waveforms is expanded in accordance with the corresponding expansion format in a direction of a temporal axis to provide a corresponding expanded frequency band-divided waveform; and a superimposing means in which, by superimposing the plurality of expanded frequency band-divided waveforms, a resultant waveform that corresponds to the original waveform that has been expanded in the direction of the temporal axis is formed;

wherein said resultant waveform is capable of being stored or reproduced.

27. The apparatus as recited in claim 26, wherein each of the plurality of frequency band-divided waveforms is generated from the original waveform by sampling the original waveform with a corresponding sampling frequency; and wherein the expansion means executes expansion processing for each frequency band-divided waveform of the plurality of frequency band-divided waveforms with a corresponding processing period that is based on the corresponding sampling frequency at which the original waveform was sampled to generate the frequency band-divided waveform.

28. The apparatus as recited in claim 26, wherein the expansion means is configured to expand each of the plurality of frequency band-divided waveforms by an identical amount.

29. A waveform expansion apparatus for expanding a plurality of temporally divided waveforms, comprising:

a processing format specification means in which a corresponding expansion processing format of a plurality of expansion processing formats is specified for each of the plurality of temporally divided waveforms during expansion, said plurality of expansion processing formats including at least two different expansion processing formats, each of the at least two different expansion processing formats for expanding waveforms; and an expansion means in which expansion processing is performed on each temporally divided waveform of the plurality of temporally divided waveforms to expand the temporally divided waveform in a direction of a temporal axis according to the specified corresponding expansion processing format to provide a corresponding resultant temporally divided waveform that is capable of being stored or reproduced.

* * * * *